US011581115B2

(12) United States Patent
Hahn et al.

(10) Patent No.: US 11,581,115 B2
(45) Date of Patent: Feb. 14, 2023

(54) SUPERCONDUCTING COIL MODULE

(71) Applicant: Seoul National University R&DB Foundation, Seoul (KR)

(72) Inventors: Seungyong Hahn, Seoul (KR); Uijong Bong, Seoul (KR); Jaemin Kim, Yongin-si (KR); Chaemin Im, Seoul (KR); Jeseok Bang, Seoul (KR); Soobin An, Seoul (KR); Jung Tae Lee, Seoul (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 191 days.

(21) Appl. No.: 17/024,371

(22) Filed: Sep. 17, 2020

(65) Prior Publication Data

US 2021/0082610 A1 Mar. 18, 2021

(30) Foreign Application Priority Data

Sep. 17, 2019 (KR) ..... 10-2019-0114259

(51) Int. Cl.

| | |
|---|---|
| ***H01F 6/06*** | (2006.01) |
| ***H01B 12/02*** | (2006.01) |
| ***H01F 6/04*** | (2006.01) |
| ***H05B 6/02*** | (2006.01) |

(52) U.S. Cl.

CPC ..... *H01F 6/06* (2013.01); *H01B 12/02* (2013.01); *H01F 6/04* (2013.01); *H05B 6/02* (2013.01)

(58) Field of Classification Search

CPC ... H01F 6/06; H01F 6/04; H01F 27/34; H01F 6/00; H01F 2006/001; H01B 12/02; H05B 6/02; H05B 6/06

See application file for complete search history.

(56) References Cited

FOREIGN PATENT DOCUMENTS

| | | |
|---|---|---|
| JP | 2010010632 | 1/2010 |
| KR | 1020160041145 | 4/2016 |
| KR | 101759963 | 7/2017 |
| KR | 1020170092266 | 8/2017 |
| KR | 101891348 | 8/2018 |

OTHER PUBLICATIONS

K.L. Kim, et al., "Study on elimination of screening-currentinduced field in pancake-type non-insulated HTS coil", Supercond. Sci. Technol., vol. 29, (2016), pp. 035009 (6pp).

Kazuhiro Kajikawa, et al., Designs and Tests of Shaking Coils to Reduce Screening Currents Induced in HTS Insert Coils for NMR Magnet Insert Coils for NMR Magnet, IEEE Transactions on Applied Superconductivity, vol. 25, No. 3, (Jun. 2015), pp. 1-5.

(Continued)

*Primary Examiner* — Mohamad A Musleh

(74) *Attorney, Agent, or Firm* — Cantor Colburn LLP

(57) ABSTRACT

A superconducting coil module includes: a first coil composed of a superconducting wire material wound multiple times; and a first heating device coupled to one surface of the first coil and including at least one first heating pattern controlling a threshold current for each turn of the first coil as a minimum threshold current, wherein at least one first heating pattern is disposed on a path according to a predetermined ratio between the inner and outer boundaries of the first coil.

11 Claims, 37 Drawing Sheets

(56) References Cited

OTHER PUBLICATIONS

Roberto Brambilla, "Integral equations for the current density in thin conductors and their solution by the finite-element method", Supercond. Sci. Technol., vol. 21, (2008), pp. 105008 (9 pages). (8pp).

Roberto Brambilla, et al., "Development of an edge-element model for AC loss computation of high-temperature superconductors", Supercond. Sci. Technol., vol. 20, (2007), pp. 16-24.

Y.J. Hwang, et al., "Feasibility study for reduction of the screening current induced field in a 2G high temperature superconducting coil", Supercond. Sci. Technol., vol. 29, (2016), 105008 (5pp).

Yoshinori Yanagisawa, et al., "Effect of coil current sweep cycle and temperature change cycle on the screening current-induced magnetic field for Ybcocoated conductor coils", AIP Conference Proceedings, vol. 1434, (2012),pp. 1373-1380.

Yoshinori Yanagisawa, et al., "Reduction of Screening Current-Induced Magnetic Field of REBCO Coils by the Use of Multi-Filamentary Tapes", IEEE Transactions on Applied Superconductivity, vol. 25, No. 3, (Jun. 2015), pp. 1-5.

Young Jin Hwang, et al., "A Study on Mitigation of Screening Current Induced Field with a 3-T 100-mm Conduction-Cooled Metallic Cladding REBCO Magnet", IEEE Transactions on Applied Superconductivity, vol. 27, No. 4, (Jun. 2017), pp. 4701605 (5 pages).

Young-Gyun Kim, et al., "Study for Reducing the Screening Current-Induced Field in a 10-MHz No-Insulation Magnet Using Current Sweep Reversal Method", IEEE Transactions on Applied Superconductivity, vol. 25, No. 3, (Jun. 2015), pp. 1-5.

SUPERCONDUCTING COIL MODULE

CROSS-REFERENCE TO RELATED APPLICATION

This application claims priority to and the benefit of Korean Patent Application No. 10-2019-0114259 filed in the Korean Intellectual Property Office on Sep. 17, 2019, the entire contents of which are incorporated herein by reference.

BACKGROUND

(a) Technical Field

The present disclosure relates to a superconducting coil module. Specifically, it relates to a superconducting coil module constituting a superconducting magnet.

(b) Description of the Related Art

In a case of a superconducting magnet, an induced current is generated by a magnetic flux density created by a conducting current when charging an operation current, which is called a screening current, and a magnetic field induced by the screening current is called a screening current-induced field (hereinafter referred to as SCF). At this time, it is known that the size of the screening current changes according to the magnetic flux density passing through the superconducting coil module constituting the magnet, and the density of the screening current corresponds to the superconducting threshold current density called critical current density.

The effects of this screening current can be largely due to (1) a reduction of the central magnetic field due to SCF (2) a distortion of the spatial magnetic field uniformity in a case of MRI/NMR, and (3) unbalanced mechanical stress within the superconducting magnet. In order to improve these problems, to compensate for the system performance deterioration related to the reduction of the central magnetic field and the distortion of the spatial magnetic field uniformity due to the SCF, methods such as current over-shooting (or a current sweep reversal technique) and field shaking have been previously proposed, and in order to compensate for the mechanical deformation, over-banding and installation of a mechanical supporter, etc. have been suggested.

Since in a point that the aforementioned conventional arts are not technologies that remove nor reduce the screening current, they cause various problems such as an increase in system complexity, an increase in system size, an increase in system cost, and a decrease in system efficiency.

Specifically, installing a supplementary device outside the system to solve the problem caused by the screening current not only increases the complexity of the existing system, but also increase the size of the system. Resultantly, this directly leads to an increase in the cost of the system. On the other hand, in the case of the current over-shooting (or the current sweep reversal technique) to reduce the size of the screening current, because it is a method in which the current flowing through the superconducting magnet is raised to a predetermined value that is larger than a preset operating current and then lowered to a predetermined operating current, there is a problem that the system cannot be operated with inherent efficiency and at a rated performance of the system.

The above information disclosed in this Background section is only for enhancement of understanding of the background of the invention, and therefore it may contain information that does not form the prior art that is already known in this country to a person of ordinary skill in the art.

SUMMARY

The present disclosure is to provide a superconducting coil module capable of controlling the screening current.

A superconducting coil module according to one aspect of the invention includes: a first coil composed of a superconducting wire material wound multiple times; and a first heating device coupled to one surface of the first coil and including at least one first heating pattern controlling a threshold current for each turn of the first coil to a minimum threshold current, wherein at least one first heating pattern is disposed on a path according to a predetermined ratio between the inner and outer boundaries of the first coil.

The predetermined ratio may depend on where the threshold current for each turn is a highest point in the first coil.

The first heating device may include a plurality of first heating patterns, the plurality of first heating patterns may include at least one first heating pattern, and the plurality of first heating patterns may be disposed at a constant interval along a direction from the outside to the inside of the first coil on a cross-section of the superconducting coil module.

The first heating device may include a plurality of first heating patterns including at least one first heating pattern, on the cross-section of the superconducting coil module, and at least one interval among the intervals between the plurality of first heating patterns may be different from other intervals.

A width of at least one of the plurality of first heating patterns may be different from a width of another first heating pattern.

A thickness of at least one among the plurality of first heating patterns may be different from a thickness of the other first heating patterns.

The first heating device may include a plurality of first heating patterns including at least one first heating pattern, at least one of the intervals between the plurality of first heating patterns, each of the widths of the plurality of first heating patterns, each of the thicknesses of the plurality of first heating patterns, and the number of the plurality of first heating patterns may be determined depending on a temperature profile for each turn according to a threshold current profile for each turn of the first coil.

The superconducting coil module may further include a second heating device coupled to the other surface of the first coil and including at least one second heating pattern controlling the threshold current for each turn of the first coil as a minimum threshold current, and at least one second heating pattern may be disposed on a path according to the predetermined ratio between the inside and outside boundaries of the first coil.

The predetermined ratio may depend on where the threshold current for each turn is a highest point in the first coil.

A superconducting coil module according to another feature of the present invention includes: a first coil composed of a superconducting wire material wound multiple times; a second coil composed of a superconducting wire material wound multiple times; a first heating device including at least one first heating pattern coupled to one surface of the first coil; a second heating device including at least one second heating pattern coupled to the other surface of the first coil and to one surface of the second coil; and a third heating device including at least one third heating pattern coupled to the other surface of the second coil. The first to third heating devices may be operated according to a temperature profile depending on a coil radius for controlling a threshold current according to each coil radius of the first coil and the second coil as a predetermined target threshold current.

The first heating device may include a plurality of first heating patterns, the plurality of first heating patterns may include at least one first heating pattern, the third heating device may include a plurality of third heating patterns, the plurality of third heating patterns may include at least one third heating pattern, and the thickness and width of the plurality of first heating patterns and the interval between the plurality of first heating patterns, and the thickness and width of the plurality of third heating patterns and the interval between the plurality of third heating patterns, may correspond to each other.

The plurality of first heating patterns may be disposed of with a constant interval according to a direction from an inner side to an outer side of the first coil on a cross-section of the superconducting coil module. On the cross-section of the superconducting coil module, at least one interval among the intervals between the plurality of first heating patterns may be different from other intervals.

The width of at least one among the plurality of first heating patterns may be different from the width of the other first heating patterns.

The thickness of at least one among the plurality of first heating patterns may be different from the thickness of other first heating patterns.

The second heating device may include a plurality of second heating patterns, the thickness, and width of the plurality of second heating patterns may be the same, and the interval between the plurality of second heating patterns may be constant.

The superconducting coil module capable of controlling the screening current is thereby provided.

DETAILED DESCRIPTION OF THE EMBODIMENTS

The present disclosure is an example of a thermal treatment method to compensate for an essential drawback of a superconductor that induces a screening current from a superconducting magnet, wherein a heating device providing a customized heating path is combined to a superconducting coil module and temperature distribution in the superconducting coil module is controlled through an optimized heating amount, thereby changing a threshold current density spatially distributed in the superconducting coil module. As a result, an absolute amount of the screening current may be reduced. Then, it is possible to prevent mechanical deformation of the superconducting coil module in the electric system including the superconducting module, as well as prevent problems such as system complexity, enlargement, and a cost increase, which are conventional art problems.

The threshold current of the superconducting coil module is changed by the temperature of the coil and the magnetic field applied within the coil. When a constant current flows through the superconducting coil module, the size of the screening current changes according to the coil temperature and the magnetic field formed in space. An exemplary embodiment of the present invention may control the temperature distribution of the coil by using a heating device customized to the module coil. Then, it is possible to alleviate the induced screening current and the SCF due to the screening current, the absolute amount of the screening current may be reduced, and the mechanical imbalance stress problem caused by the SCF may be solved.

Hereinafter, an exemplary embodiment of the present invention is described with reference to the drawings. Terms and words used in the present specification and claims are not to be construed as having a general or dictionary meaning, but are to be construed as having meanings and concepts meeting the technical ideas of the present disclosure based on a principle that the present inventors may appropriately define the present invention as the concepts of terms in order to describe their disclosures in the best mode. Therefore, the configurations described in the exemplary embodiments and drawings of the present invention are merely most preferable embodiments but do not represent all of the technical spirits of the present invention. Thus, the present invention should be construed as including all changes, equivalents, and substitutions included in the spirit and scope of the present invention at the time of filing this application.

Figure 1:
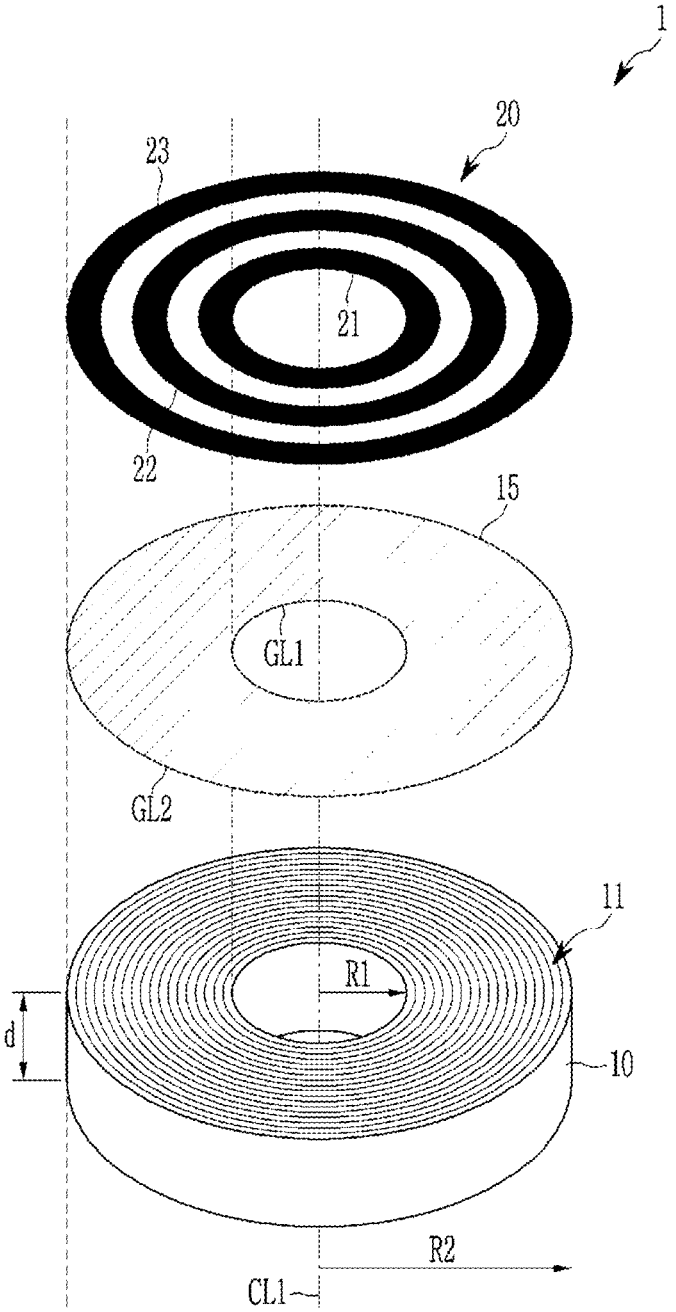
FIG. 1 is an exploded view showing a superconducting coil module and a heating device according to an exemplary embodiment.

FIG. 1 is an exploded view showing a superconducting coil module and a heating device according to an exemplary embodiment.

FIG. 1 shows that the superconducting coil module 1 includes a coil and a electric-heater to mitigate screening currents in superconducting magnets. Hereinafter, the coil is referred to as a pancake coil having a pancake structure among coils of various structures, however, the present invention is not limited thereto. In addition, hereinafter, the electric-heater is referred to a heating device.

The pancake coil 10 is a coil composed by winding a superconducting wire material 11 having a width d.

As shown in FIG. 1, the pancake coil 10 may have a shape in which the superconducting wire material 11 is not wound in the center region having a radius R1 based on the centerline CL1. The superconducting wire material 11 is a flat member having a width (d), and a pancake coil 10 may be manufactured by winding the superconducting wire material 11 on a bobbin having a radius R1, but the present invention is an example and is not limited thereto. Hereinafter, when the superconducting wire material 11 for constituting the pancake coil 10 is wound, it is referred to as "a wound member".

Although not shown in FIG. 1, a bobbin leg having a radius of R1 of an external circumferential surface may be coupled to the inside of the empty central region. Thus, the pancake coil shown in FIG. 1 is an example for explaining an exemplary embodiment, but the invention is not limited thereto.

The heating device 20 includes three heating patterns 21, 22, and 23. The heating patterns 21-23 are three circular stripe patterns with different radiuses based on the centerline CL1, and each may be a metal pattern having a predetermined thickness and width. Each of the heating patterns 21-23 may control the amount of heat generated according to the flowing current, and the arrangement of the heating patterns 21-23 shown in FIG. 1 is an example, but the arrangement may vary depending on the design.

FIG. 1 does not show the connection relation between the heating patterns to show the arrangement of the heating pattern and the interval of the heating patterns, but the heating pattern may be electrically connected to the adjacent heating pattern. In addition, FIG. 1 shows only three heating patterns, but this is also an example for explaining an exemplary embodiment, and the number of the heating patterns may be changed according to design. In addition, FIG. 1 shows only some configurations for describing an exemplary embodiment, and other components constituting the superconducting module may be added and/or combined.

In an exemplary embodiment, an interval between the heating patterns, each of the thicknesses of the heating patterns, each of the widths of the heating patterns, and a number of the heating patterns may be changed and/or modified according to a threshold current density characteristic curve of the pancake coil.

In FIG. 1, the upper plane 15 of the pancake coil 10 is shown in shades to explain the arrangement between the pancake coil 10 and the heating device 20. The heating device 20 is disposed within the upper plane 15, and the temperature of each pattern 21-23 of the heating device 20 may be controlled according to the threshold current for each turn of the wound member of the corresponding pancake coil 10 or according to the radius of the coil. Since the radius of the coil increases as the number of turns increases, the threshold current for each turn and the threshold current according to the radius of the coil may have the same meaning.

In order for the heating device 20 to control its temperature according to the threshold current, first, information related to the minimum threshold current of the superconducting coil module in the operation temperature is required when the superconducting coil module actually operates as the superconducting magnet. The minimum threshold current may be determined by the operation temperature and the operation current of the superconducting coil module.

For example, the heating device 20 may make the threshold current for each turn of the pancake coil the minimum threshold current. For example, it is supposed that a nitrogen-cooled 77K superconducting wire material is wound at 3 turns in the pancake coil 10. When the threshold current for the first turn is 100 A, the threshold current for the second turn is 70 A, and the threshold current for the third turn is 80 A, the heating device 20 may be designed to supply the heat required to make the threshold current for each turn 70 A. At this time, in the assumption, there may be a basic premise that the superconducting threshold current becomes 0 at 90-92 K and the threshold current decreases linearly with increasing temperature. Then, the heat generator 20 may theoretically supply heat so that the first turn is 81.5 K, the second turn is 77 K, and the third turn is 78.875 K.

Although not shown in FIG. 1, the superconducting coil module according to an exemplary embodiment may include a configuration for controlling the heating device 20, and the corresponding configuration may include precise experimental information regarding the threshold current density of the superconducting wire material at various operating temperatures of the superconducting coil module. For example, the minimum threshold current of the superconducting coil module may be generally calculated by a radial magnetic field and an axial magnetic field. When calculating the magnetic field and threshold current of the superconducting coil module, the minimum threshold current is calculated at the first turn, the maximum threshold current is calculated at about ⅔ of the outermost radius (R2 in FIG. 1) from the center of the superconducting coil module, and the threshold current tends to decrease after about ⅔ of the point (see FIG. 5).

In addition, in the temperature control of the heating device 20, the screening current, the SCF, and the mechanical stress may be considered. For this, an electromagnetic and mechanical analysis model by screening current and the design and measurement information for the superconducting coil module may be required. For example, a simulation program called as a COMSOL, which is a multi-physics analysis program, may be used to calculate the SCF based on the screening current. A differential equation (partial derivative equation, pde) module that directly establishes and solves an equation for calculating the SCF for a superconducting coil module to which the exemplary embodiment is applied may be used. A partial derivative equation (pde) module that directly establishes and solves an equation for calculating the SCF for the superconducting coil module to which the exemplary embodiment is applied may be used. To solve the partial derivative equation, an H-formulation and domain homogenization technique is required, the H-formulation is introduced in a paper "Development of an edge-element model for AC loss computation of high-temperature superconductors (Roberto Brambilla et al. 2007 Supercond. Sci. Technol. 2016)", and the domain homogenization is introduced in a paper "Calculation of AC losses in large HTS stacks and coils" (Zermeno et al. Proceedings of International Conference on Coated Conductors for Applications (CCA2012))".

In the method of calculating the mechanical stress, the stress generated by an electromagnetic force (Lorentz force, etc.) and a winding/bending stress of the superconducting coil module may be calculated through predetermined limit conditions and a general Hook's Law and equilibrium mechanics theory. Specifically, the mechanical stress generated in the superconducting coil module may be calculated through an in-housing code and COMSOL solid mechanics.

As described above, in the design of the heating device 20, electromagnetic and mechanical analyses are required to quantitatively evaluate and calculate the amount of the screening current reduced by the heating device 20. For example, in the case of the superconducting coil module that outputs a high magnetic field, the mechanical imbalance stress may occur due to the screening current, resulting in the mechanical deformation and damage. It is determined how much the generated stress must be reduced to prevent the mechanical deformation and damage, and it is determined how much the heating device 20 should reduce the screening current to provide the calculated stress reduction. Specifically, if maximum stress that may be applied to the inside of the superconducting coil module without the mechanical damage and deformation is 700 MPa and maximum mechanical stress expected by the screening current is 800 MPa, the amount of the screening current to reduce the mechanical stress by about 100 MPa may be calculated. The heating pattern of the heating device 20 may be designed based on the temperature of the superconducting coil module to reduce the calculated screening current.

Subsequently, each heat transfer of the heating patterns 21-23 of the heating device 20 is calculated through heat transfer modeling so that optimal heating patterns 21-23 may be designed. For example, a thermal circuit design for the heat transfer modeling, a coefficient setting of the designed thermal circuit, and thermal circuit design of the heating device and the superconducting coil module are required.

In addition, in the structure in which two or more superconducting coil modules constituting the superconducting magnet are stacked, information for the threshold current per turn of each superconducting coil module is required when a certain current flows through each superconducting coil module. In FIG. 1, the superconducting coil module has a single layer, but two or more superconducting coil modules may be stacked, and the heating device may be disposed between two adjacent superconducting coil modules. The information for the threshold current is obtained according to the number of the turns of the wound member in the position of each superconducting coil module and each superconducting coil module, and the heating device of the corresponding position and the temperature of the heating pattern of the heating device may be controlled according to the information for the acquired threshold current.

Hereinafter, exemplary embodiments of various heating devices according to the superconducting coil module are described with reference to drawings.

First, the overall configuration of the superconducting coil module is described with reference to the overall exploded view of the superconducting coil module. FIG. 1 only shows the pancake coil and the heating device among the configurations of the superconducting coil module, however other configurations may be included, and an example thereof is shown in FIG. 2.

Figure 2:
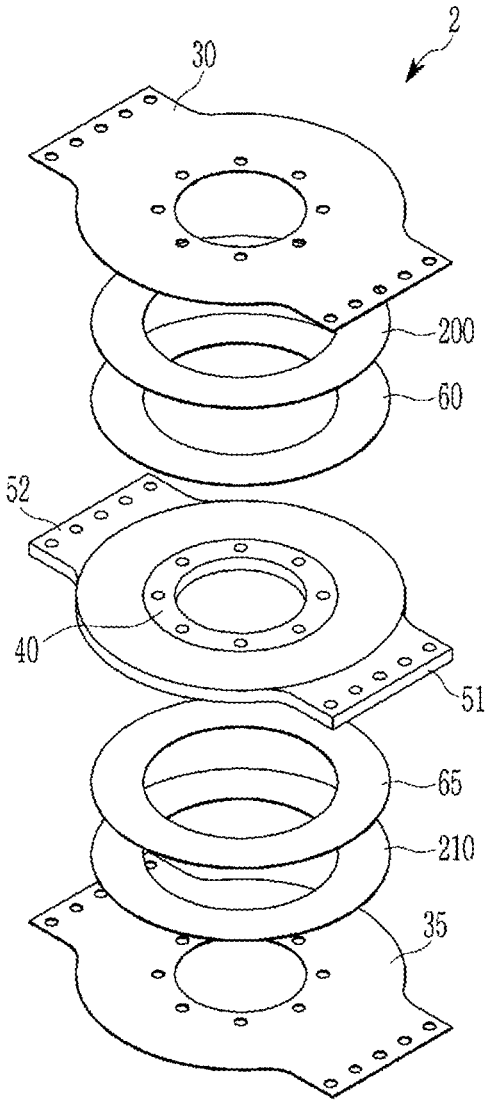
FIG. 2 is an exploded view of a superconducting coil module according to an exemplary embodiment.

FIG. 2 is an exploded view of a superconducting coil module according to an exemplary embodiment.

The superconducting coil module 2 includes two bobbin wings 30 and 35, two heating devices 200 and 210, a pancake coil 100, a bobbin leg 40, a cooling channel 50, and two films 60 and 65. The heating devices 200 and 210 and the pancake coil 100 may be designed as described above.

The cooling channel 50 may be implemented in a shape suitable for the cooling space provided according to the shape of the bobbin wings 30 and 35 and the thickness of the pancake coil 100 among the entire circumference of the pancake coil 100. The cooling channel 50 includes a first cooling channel 51 and a second cooling channel 52, but the invention is not limited thereto, and the number may vary according to the shape of the bobbin wings 30 and 35. The cooling channel 50 may be formed of copper.

The bobbin leg 40 may be mechanically coupled to the inner side of the pancake coil 100. The bobbin leg 40 and the two bobbin wings 30 and 35 have holes for the coupling, and a structure or groove for the fastening may be formed on the inner surface of the hole.

The heating device 200 and the heating device 210 are disposed on one side and the other side of the pancake coil 100, respectively, and may be closely coupled to the pancake coil 200 by fastening two bobbin wings 30 and 35.

In FIG. 2, the film 60 is disposed between one side of the pancake coil 100 and the heating device 200, and the film 65 is disposed between the other side of the pancake coil 100 and the heating device 210. The films 60 and 65 are Kapton films that may prevent damage caused by direct heat transfer from the heating devices 200 and 210 to the pancake coil 100. The present invention is not limited thereto, and configurations other than the films 60 and 65 may be added, a film may be replaced with another configuration, or a film may not be provided.

Each of the heating devices 200 and 210 includes a plurality of heating patterns, and each of the plurality of heating patterns may be implemented as an optimal pattern for controlling the temperature according to the threshold current for each turn on the corresponding surface of the pancake coil 100. For the heating pattern according to an exemplary embodiment, the interval between the heating patterns, each of the thicknesses of the heating pattern, each of the widths of the heating pattern, and the number of heating patterns may be designed to control the temperature depending on the threshold current for each turn.

The bobbin wing 30 may be coupled with the cooling channel 50 at a position corresponding to one side of the pancake coil 200, and the bobbin wing 35 may be coupled with the cooling channel 50 at a position corresponding to the other side of the pancake coil 200. For this coupling, a hole may be formed in each of the bobbin wings 30 and 35 and the cooling channel 50, and a structure or groove for the fastening may be formed on the inner surface of the hole.

Figure 3:
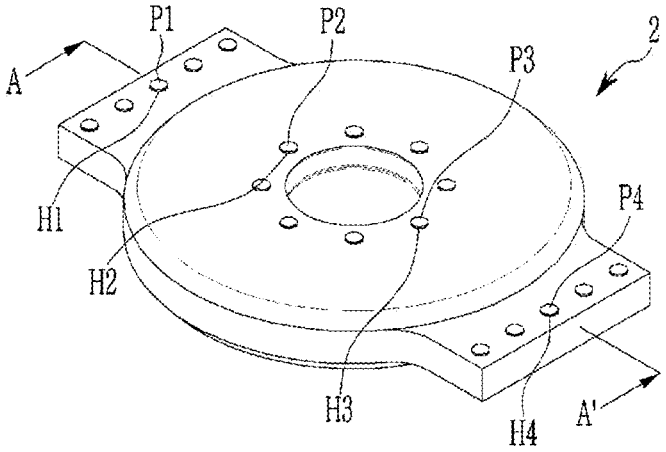
FIG. 3 is a perspective view of a superconducting coil module.
Figure 4:
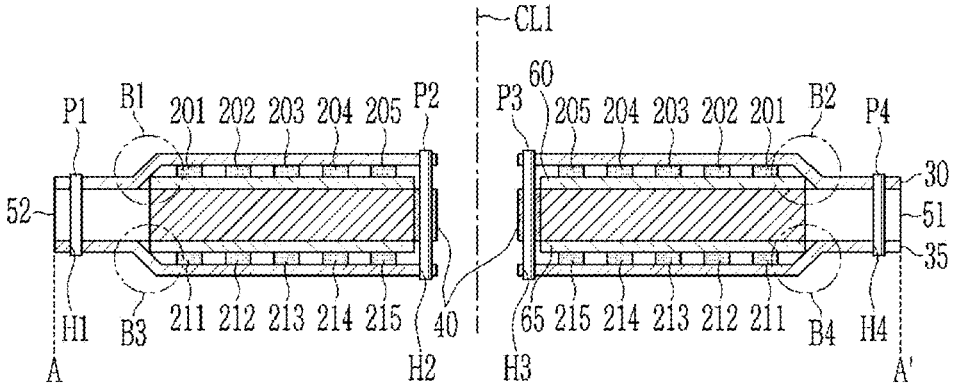
FIG. 4 is a cross-sectional view of the superconducting module shown in FIG. 3 based on a cutting line A-A'.

FIG. 3 is a perspective view of a superconducting coil module, and FIG. 4 is a cross-sectional view of the superconducting module shown in FIG. 3 based on a cutting line A-A'.

As shown in FIG. 3, the cutting line A-A' may pass through holes H1-H4 of the superconducting coil module 2. A fastening means P1-P4 may be coupled to each hole. Although the shape of the fastening means is not described in detail in FIG. 4, it is obvious that various known fastening means may be applied.

Five heating patterns of the same thickness, width, and interval of the heating devices 200 and 210 are shown in FIG. 4, but this is an example for explaining the invention, and it is not limited thereto.

As shown in FIG. 4, it is a left-right symmetric structure with respect to the centerline CL1, and the films 60 and 65 are positioned between a plurality of heating patterns 201-205 and a plurality of heating patterns 211-215, and the pancake coil 100.

The bobbin wing 30 covers the first and second cooling channels 51 and 52, the film 60, a plurality of heating patterns 201-205, and one surface of the pancake coil 100, and the bobbin wing 35 covers the first and second cooling channels 51 and 52, the film 65, a plurality of heating patterns 211-215, and the other surface of the pancake coil 100.

In FIG. 4, in order to show the stacking structure between the components according to an exemplary embodiment, each component is shown without regard to the actual thickness of each component. In the regions B1-B4 of FIG. 3 and FIG. 4, the bobbin wings 30 and 35 are shown with the curved shape by the step of the stacking structure, however, the films 60 and 65 and the plurality of heating patterns 201-205 and 211-215 substantially have a very thin thickness compared with the pancake coil and bobbin wings such that they may be substantially flat without being curved like in FIG. 3 and FIG. 4.

In addition, in FIG. 4, the plurality of heating patterns 201-205 and 211-215 are shown, but numerous variations are possible according to the threshold current for each turn, and the various exemplary embodiments thereof are described with reference to the drawings. In the corresponding drawings, for convenience of explanation, only a portion for exposing the heating pattern in the superconducting coil module may be shown.

First, a concept of how the heating device according to an exemplary embodiment controls the temperature of the heating pattern according to the threshold current per turn is described.

Figure 5:
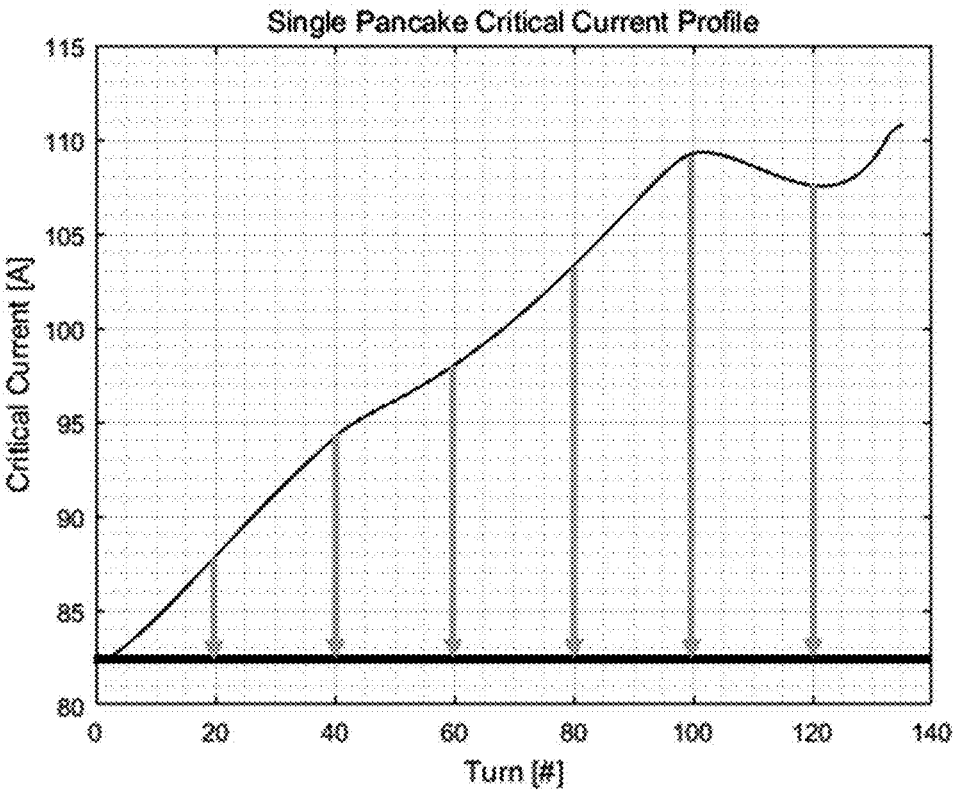
FIG. 5 is a graph showing a threshold current per turn in a pancake coil.

FIG. 5 is a graph showing a threshold current per turn in a pancake coil.

As shown in FIG. 5, the threshold current increases as the number of the turns increases, and the screening current increases according to the threshold current. The heating device of an exemplary embodiment increases the temperature of the coil as the number of the turns increases in order to attenuate the screening current.

Figure 6:
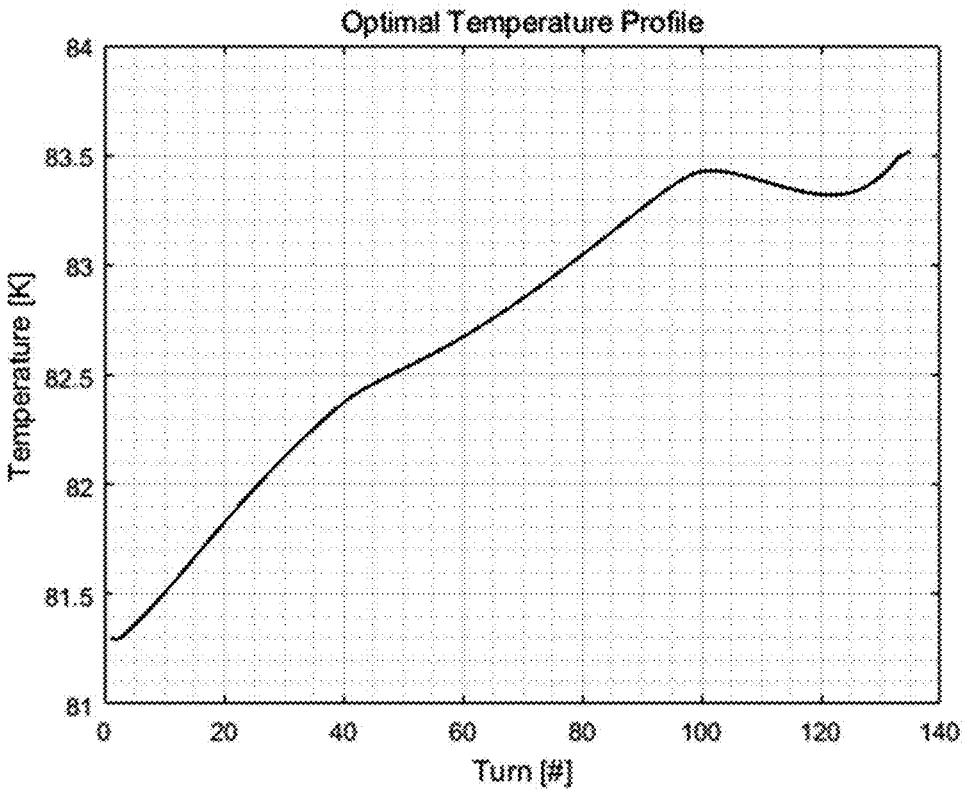
FIG. 6 is a graph showing a temperature profile per turn according to an exemplary embodiment corresponding to the graph of the threshold current per turn of FIG. 5.

FIG. 6 is a graph showing a temperature profile per turn according to an exemplary embodiment corresponding to the graph of the threshold current per turn of FIG. 5.

In the heating device according to an exemplary embodiment, a plurality of heating patterns may be implemented to follow the temperature profile for each turn shown in FIG. 6 corresponding to the threshold current profile for each turn.

Ideally, if the heating device supplies heat to the pancake coil like the temperature profile for each turn shown in FIG. 6, like the vertical direction arrows in FIG. 5, the threshold current for each turn decreases, and the entire pancake coil may be controlled with the minimum threshold current value indicated by a thick solid line.

Hereinafter, various heating patterns designed based on the temperature profile for each turn shown in FIG. 6 are introduced. When the same current flows in the heating pattern, the amount of heat is different depends on the cross-sectional area of the heating pattern and the length of the heating pattern. For example, as the cross-sectional area increases (decreases), the amount of heat decreases (increases), and as the length of the heating pattern becomes longer (shorter), the amount of heat generation increases (decreases). As the position of the heating pattern moves away from the centerline of the coil, the length of the heating pattern increases, and the resistance increases under the same current condition, resulting in an increase in the amount of heat generated.

When the interval between the plurality of heating patterns is the same, at least one of each of the conduction currents of a plurality of heating patterns and the number of the patterns may be design parameters for adjusting the amount of heat generated.

Figure 7:
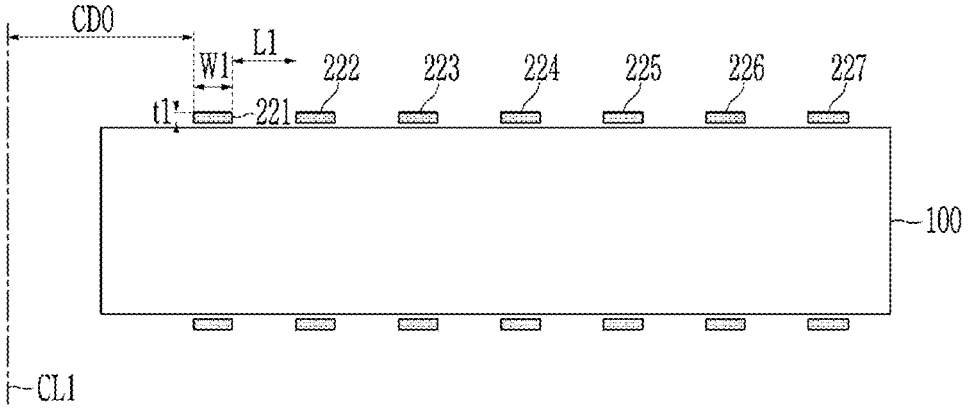
FIG. 7 to FIG. 19 are views showing a cross-section of a heating pattern according to an exemplary embodiment, respectively.

FIG. 7 is a view showing a cross-section of a heating pattern according to an exemplary embodiment.

For the convenience of explanation, in FIG. 7, only the right region of the pancake coil 100 and the right heating pattern of the heating device 200 are shown based on the centerline CL1 (referring to FIG. 4). In addition, the heating pattern positioned on the other side of the pancake coil 100 (corresponding to the heating patterns 211-215 in FIG. 4) is assumed to be the same as the heating patterns (corresponding to the heating patterns 201-205 in FIG. 4) if is assumed that the temperature profile for each turn for one surface and the other surface of the pancake coil 100 is the same. The invention is not limited thereto, and when the superconducting coil module is implemented with a plurality of coil layers, the heating patterns may be different. In addition, even if the single layer has different temperature profiles for each turn on one surface and the other surface, the heating patterns may be different. In FIG. 7, the distance CD0 from the centerline CL1 to the heating pattern (e.g., 221) of the nearest heating device 200 and the heating device 210 may also be changed according to a design for implementing the temperature profile for each turn. This applies equally to all exemplary embodiments below.

As shown in FIG. 7, it is shown that a plurality of heating patterns 221-227 have the same thickness t1 and width W1, the intervals L1 between a plurality of heating patterns 221-227 are the same, and the number thereof is seven. In order to implement the temperature profile (e.g., as in FIG. 6) for each turn according to the threshold current for each turn, each of the conduction currents of the plurality of heating patterns 221-227 may be controlled. For example, in FIG. 7, as the distance from the centerline CL1 increases, the length of the heating patterns 221-227 becomes longer, so in the condition where the same current flows, the amount of heat may increase as the distance from the centerline CL1 increases. In the temperature profile for each turn shown in FIG. 6, since the temperature decreases and then increases at about the ⅔ point, the conduction current of the heating pattern 226 and the heating pattern 227 may be less than that of the heating patterns 221-225 to realize this.

Although seven heating patterns are shown in FIG. 7, this may also be designed with an appropriate number to implement the temperature profile (e.g., as in FIG. 6) for each turn.

Figure 8:
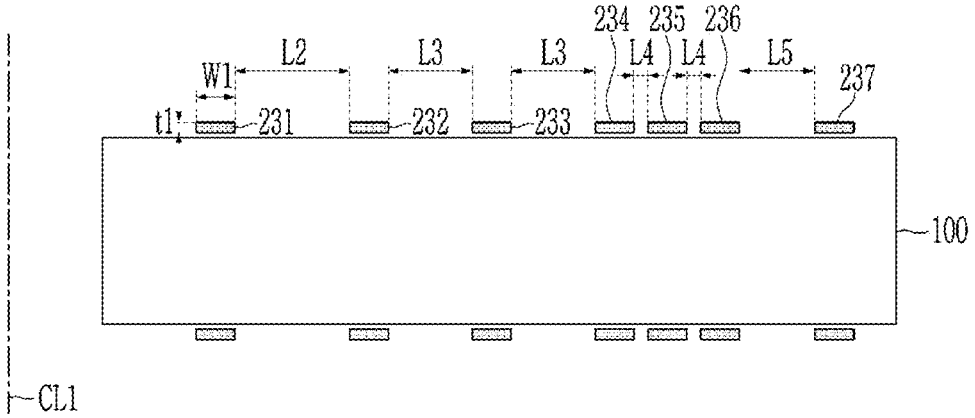

FIG. 8 is a view showing a cross-section of a heating pattern according to an exemplary embodiment.

In the exemplary embodiment of FIG. 8, the intervals L2-L7 between heating patterns 231-237 are different. For example, the intervals become shorter (L2>L3>L4) away from the centerline CL1, and then the interval L5 becomes longer again. In FIG. 8, the interval L4 between the heating patterns 234-236 is shown to be the same, but the exemplary embodiment is not limited thereto, and the interval may gradually decrease, or may decrease and then increase.

Each of the conduction currents of the heating patterns 231-237 may be the same. That is, in order to implement the temperature profile for each turn when the same current flows, the intervals between the heating patterns 231-237 may be adjusted. However, the exemplary embodiment of FIG. 8 is not limited thereto, and the conduction current of the heating patterns 231-237 may be adjusted for more precise temperature control.

Figure 9:
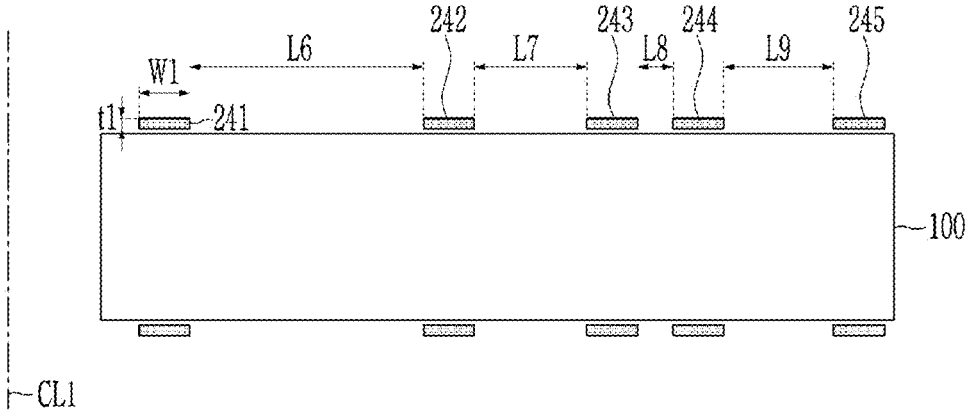

FIG. 9 is a view showing a cross-section of a heating pattern according to an exemplary embodiment.

In the exemplary embodiment of FIG. 9, the number of heating patterns 241-245 is different from that of the exemplary embodiment of FIG. 7 and the intervals L6-L9 between the heating patterns 241-245 are different. For example, the intervals become shorter (L6>L7>L8) away from the centerline CL1 and then the interval L9 becomes longer again.

Each of the conduction currents of the heating patterns 241-245 may be the same. That is, in order to implement the temperature profile for each turn when the same current flows, the number of the heating patterns 241-245 and the intervals between the heating patterns 241-245 may be adjusted. However, the exemplary embodiment of FIG. 9 is not limited thereto, and the number of the heating patterns 241-245 may be different from that shown in FIG. 9, and each of the conduction currents of the heating patterns 241-245 may be adjusted for more precise temperature control.

Figure 10:
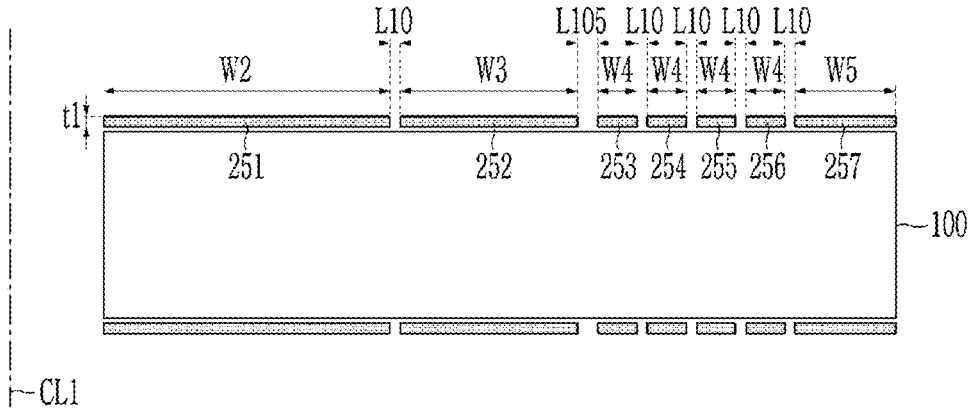

FIG. 10 is a view showing a cross-section of a heating pattern according to an exemplary embodiment.

In the exemplary embodiment of FIG. 10, the widths W2-W5 of the heating patterns 251-257 are different. For example, the widths become shorter (W2>W3>W4) away from the centerline CL1, and then the width W5 becomes longer. In FIG. 10, it is shown that the widths W4 of the heating patterns 253-256 are the same, however, the exemplary embodiment of FIG. 10 is not limited thereto, and the widths of the heating pattern 253-256 may gradually decrease, decrease and increase, and so on to be different. In the exemplary embodiment shown in FIG. 10, the interval L10 between the heating patterns 251-252 and 253-257 is the same and the interval L105 between the heating patterns 252 and 253 is wider than the intervals L10.

Each of the conduction currents of the heating patterns 251-257 may be the same. That is, in order to implement the temperature profile for each turn when the same current flows, each of the widths of the heating patterns 251-257 may be adjusted. However, the exemplary embodiment of FIG. 10 is not limited thereto, and each of the conduction currents of the heating patterns 251-257 may be adjusted for more precise temperature control.

Figure 11:
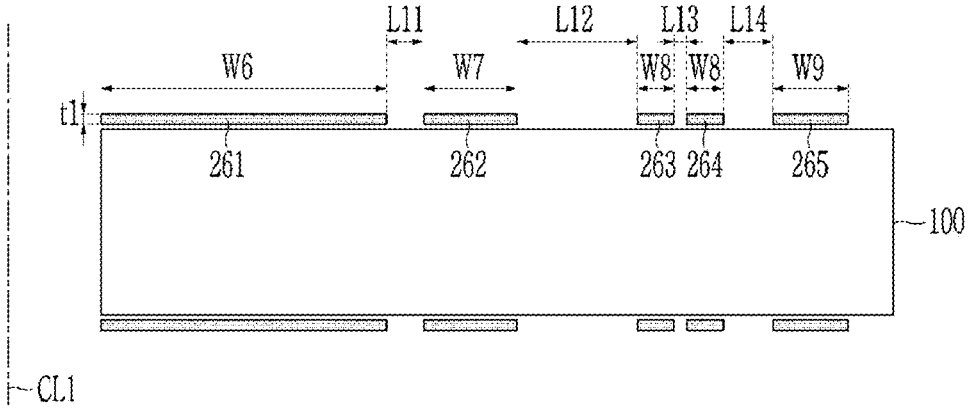

FIG. 11 is a view showing a cross-section of a heating pattern according to an exemplary embodiment.

In the exemplary embodiment of FIG. 11, the number of heating patterns 261-265 is different from the exemplary embodiment of FIG. 7, and the widths W6-W9 and the intervals L11-L14 of the heating patterns 261-265 are different. In the exemplary embodiment shown in FIG. 11, the number of the heating patterns 261-265 is five, and the intervals between the heating patterns 261-265 may increase (L11>L12) away from the centerline CL1, become shorter (L12>L13), and then be lengthened again (L14>L13). Also, as the distance from the centerline CL1 increases, the widths of the heating patterns 261-265 may become shorter (W6>W7>W8), and then the width W9 becomes longer (W9>W8). In FIG. 11, it is shown that the widths W4 of the heating patterns 263-264 are the same, however, the exemplary embodiment of FIG. 11 is not limited thereto and they may be different.

Each of the conduction currents of the heating patterns 261-265 may be the same. That is, in order to implement the temperature profile for each turn when the same current flows, the number of the heating patterns 261-265, the intervals between the heating patterns 261-265, and each of the widths thereof may be adjusted. However, the exemplary embodiment of FIG. 11 is not limited thereto, and each of the conduction currents of the heating patterns 261-265 may be adjusted for more precise temperature control.

Figure 12:
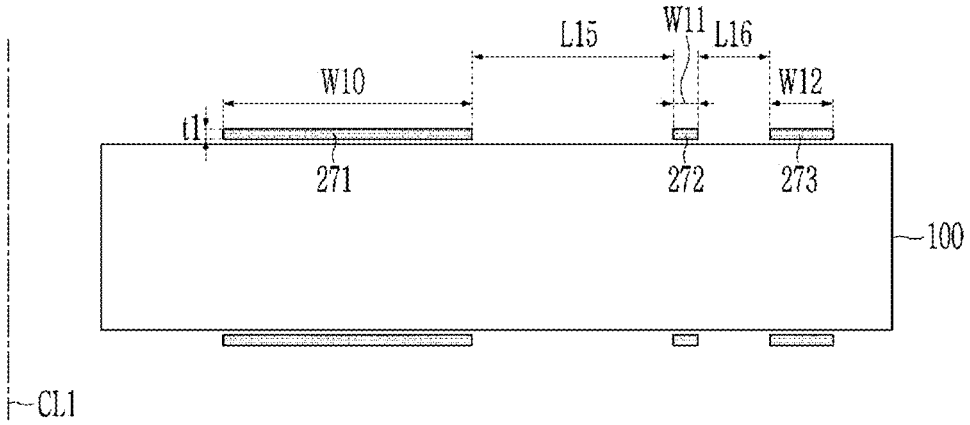

FIG. 12 is a view showing a cross-section of a heating pattern according to an exemplary embodiment.

In the exemplary embodiment of FIG. 12, the number of heating patterns 271-273 is different from that of the exemplary embodiment of FIG. 7, and the widths W10-W12 of the heating patterns 271-273 and the intervals L15-L16 thereof are different from each other. In the exemplary embodiment shown in FIG. 12, the number of the heating patterns 271-273 is three, and the intervals between the heating patterns 271-273 may be shorter (L15>L16) as the distance from the centerline CL1 increases. Also, as the distance from the centerline CL1 increases, the widths of the heating patterns 271-273 may become shorter (W10>W11), and then the width may become longer (W12>W11).

Each of the conduction currents of the heating patterns 271-273 may be the same. That is, in order to implement the temperature profile for each turn when the same current flows, the number of the heating patterns 271-273, the intervals between the heating patterns 271-273, and each of the widths may be adjusted. However, the exemplary embodiment of FIG. 12 is not limited thereto, and each of the conduction currents of the heating patterns 271-273 may be adjusted for more precise temperature control.

Figure 13:
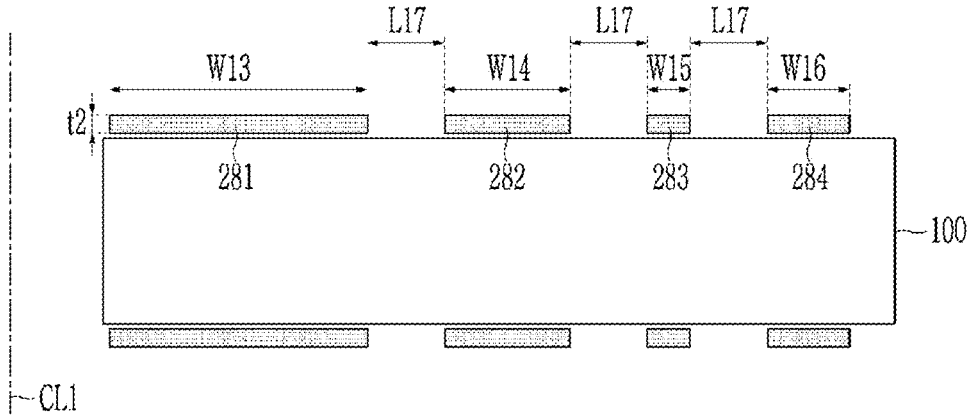

FIG. 13 is a view showing a cross-section of a heating pattern according to an exemplary embodiment.

In the exemplary embodiment of FIG. 13 compared with the exemplary embodiment shown in FIG. 7, the thicknesses of heating patterns 281-284 are different and the widths W2-W5 of the heating patterns 281-284 are different. In the exemplary embodiment shown in FIG. 13, the intervals L17 between the heating patterns 281-284 are constant. For example, the thickness t2 of the heating patterns 281-284 is thicker than the thickness t1. The further away from the centerline CL1, the widths of the heating patterns 281-283 may become shorter (W13>W14>W15) and then longer (W16>W15).

Each of the conduction currents of the heating patterns 281-284 may be the same. That is, when the same current flows, each of the widths of the heating pattern 281-284 may be adjusted to implement the temperature profile for each turn. However, the exemplary embodiment of FIG. 13 is not limited thereto, and each of the conduction currents of the heating patterns 281-284 may be adjusted for more precise temperature control.

Figure 14:
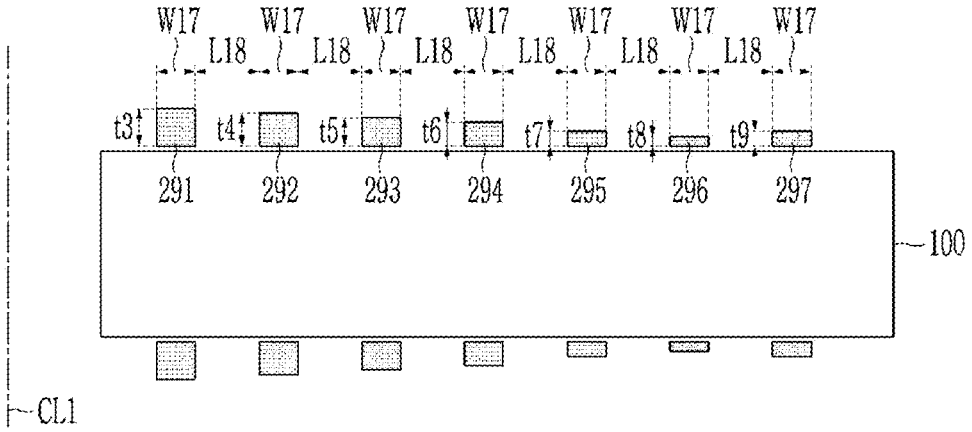

FIG. 14 is a view showing a cross-section of a heating pattern according to an exemplary embodiment.

In the exemplary embodiment of FIG. 14, the thicknesses of the heating patterns 291-297 are different from each other, and the widths W17 of the heating patterns 291-297 and the intervals between the heating patterns 291-297 are constant. In the exemplary embodiment shown in FIG. 14, the thicknesses of the heating patterns 291-297 may become thinner (t3>t4>t5>t6>t7>t8) and thicker (t9>t8) as the distance from the centerline CL1 increases.

Each of the conduction currents of the heating pattern (291-297) may be the same. That is, each of the thicknesses of the heating patterns 291-297 may be adjusted to implement the temperature profile for each turn when the same current flows. However, the exemplary embodiment of FIG. 14 is not limited thereto, and each of the conduction currents of the heating pattern 291-297 may be adjusted for more precise temperature control.

Figure 15:
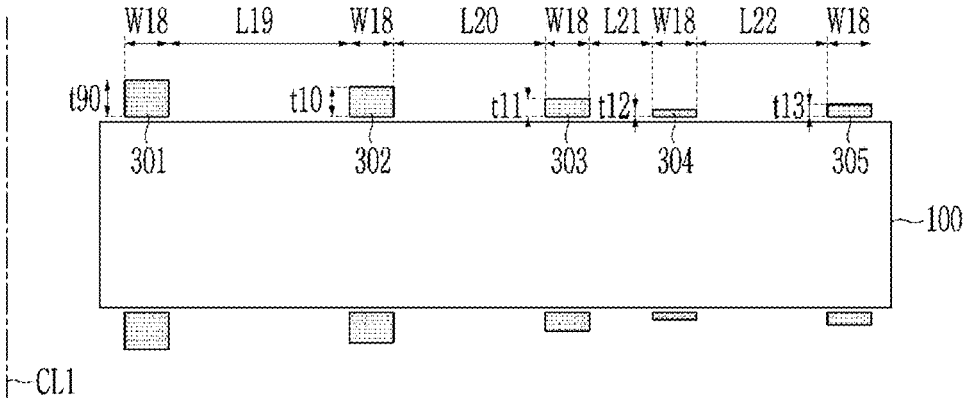

FIG. 15 is a view showing a cross-section of a heating pattern according to an exemplary embodiment.

In the exemplary embodiment of FIG. 15, the thicknesses of the heating patterns 301-305 and the intervals between the heating patterns 301-305 are different from each other, and the widths W18 of the heating patterns 301-305 are constant. In the exemplary embodiment shown in FIG. 15, the number of the heating patterns 301-305 is five, and the thicknesses of the heating patterns 301-305 decrease becomes thinner (t90>t10>t11>t12) and then thicker as the distance from the centerline CL1 increases. The intervals between the heating patterns 301-305 may be shorter (L19>L20>L21) and longer (L22>L21) as the distance from the centerline CL1 increases.

Each of the conduction currents of the heating patterns 301-305 may be the same. That is, in order to implement the temperature profile for each turn when the same current flows, the intervals between the heating patterns 301-305 and the thicknesses between the heating patterns 301-305 may be adjusted. However, the exemplary embodiment of FIG. 15 is not limited thereto, and each of the conduction currents of the heating patterns 301-305 may be adjusted for more precise temperature control.

Figure 16:
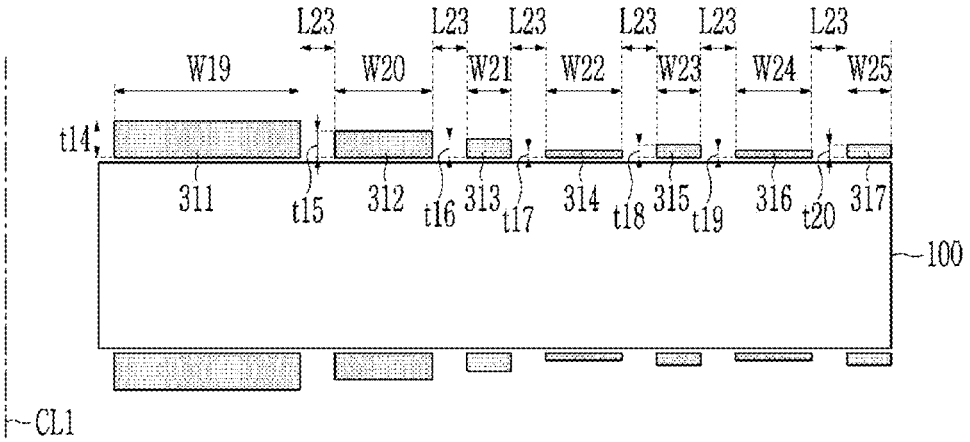

FIG. 16 is a view showing a cross-section of a heating pattern according to an exemplary embodiment.

In the exemplary embodiment of FIG. 16, the widths W19-W25 and the thicknesses t14-t20 of heating patterns 311-317 may be different and the intervals L23 of the heating patterns 311-317 may be constant. In the exemplary embodiment shown in FIG. 16, the number of the heating patterns 311-317 is seven, and the thicknesses of the heating patterns 311-317 may be thinner (t14>t15>t16>t17), thicker (t18>t17), and then thinned again (t20>t19) as the distance from the centerline CL1 increases. The widths of the heating patterns 311-317 may narrow (W19>W20>W21), widen (W22>W21), and then narrow again (W22>W23) moving away from the centerline CL1. Subsequently, the width of the heating patterns 311-317 may be widened again (W24>W23) and narrowed again (W24>W25).

Each of the conduction currents of the heating patterns 311-317 may be the same. That is, each of the widths and thicknesses of the heating patterns 311-317 may be adjusted to implement the temperature profile for each turn when the same current flows. However, the exemplary embodiment of FIG. 16 is not limited thereto, and each of the conduction currents of the heating patterns 311-317 may be adjusted for more precise temperature control.

Figure 17:
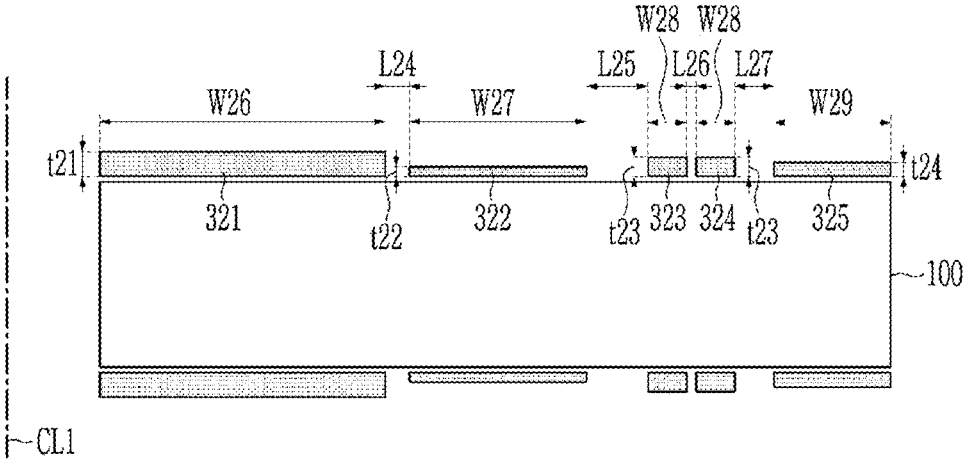

FIG. 17 is a view showing a cross-section of a heating pattern according to an exemplary embodiment.

In the exemplary embodiment of FIG. 17, the widths W26-W29 and the thicknesses t21-t24 of the heating patterns 321-325 are different from each other, and the intervals L24-L27 between the heating patterns 321-325 may also be different from each other. In the exemplary embodiment shown in FIG. 17, the number of the heating patterns 321-325 is five, and the thicknesses of the heating patterns 321-325 becomes thinner (t21>t22>t23) and thicker (t24>t23) as the distance from the centerline CL1 increases. The widths of the heating patterns 321-325 may be narrower (W26>W27>W28) and wider (W29>W28) moving away from the centerline CL1. The intervals between the heating patterns 321-325 may widen (L25>L24), narrow (L25>L26), and widen again (L27>L26) as the distance from centerline CL1 increases.

Each of the conduction currents of the heating patterns 321-325 may be the same. That is, in order to implement the temperature profile for each turn when the same current flows, each of the widths and thicknesses of the heating patterns 321-325 and the intervals between the heating patterns 321-325 may be adjusted. However, the exemplary embodiment of FIG. 17 is not limited thereto, and each of the conduction currents of the heating patterns 321-325 may be adjusted for more precise temperature control.

Figure 18:
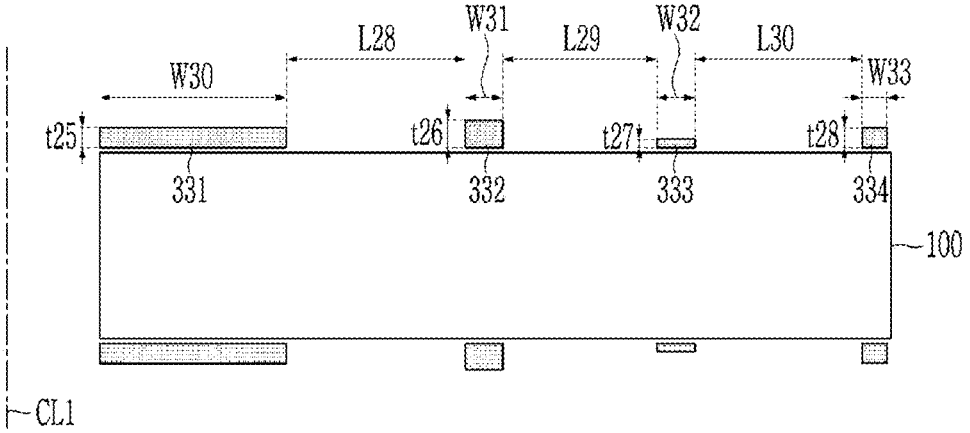

FIG. 18 is a view showing a cross-section of a heating pattern according to an exemplary embodiment.

In the exemplary embodiment of FIG. 18, the widths W30-W33 and thicknesses t25-t28 of the heating patterns 331-334 may be different from each other, and the intervals L28-L30 between the heating patterns 331-334 may be different from each other. In the exemplary embodiment shown in FIG. 18, the number of the heating patterns 331-334 is four, and the thicknesses of the heating patterns 331-334 may be thicker (t26>t25), thinner (t26>t27), and then thicker again (t28>t27) moving away from the centerline CL1. The widths of the heating patterns 331-334 may be narrower (W30>W31), wider (W32>W21), and narrower (W32>W33) as the distance from the centerline CL1 increases. The intervals between the heating patterns (331-334) become narrower (L28>L29) and wider (L30>L29) moving away from the centerline CL1.

Each of the conduction currents of the heating patterns 331-334 may be the same. That is, in order to implement the temperature profiles for each turn when the same current flows, each of the widths and thicknesses of the heating patterns 331-334 and the intervals between the heating patterns 331-334 may be adjusted. However, the exemplary embodiment of FIG. 18 is not limited thereto, and each of the conduction currents of the heating patterns 331-334 may be adjusted for more precise temperature control.

Figure 19:
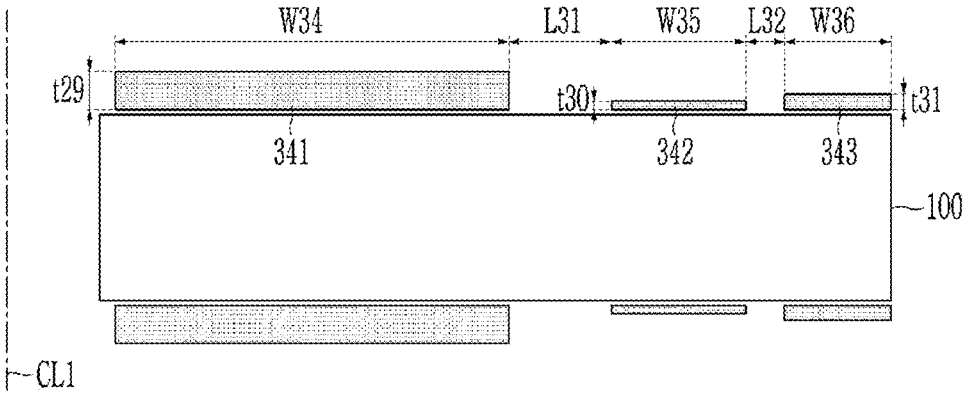

FIG. 19 is a view showing a cross-section of a heating pattern according to an exemplary embodiment.

In the exemplary embodiment of FIG. 19, the widths W34-W36 and thicknesses t29-t31 of the heating patterns 341-343 may be different, and the intervals L31-L32 between the heating patterns 341-343 may also be different. In the exemplary embodiment shown in FIG. 19, the number of the heating patterns 341-343 is three, and the thicknesses of the heating patterns 341-343 may be thinner (t30>t29) and thicker (t31>t30) away from the centerline CL1. The widths of the heating patterns 341-343 may be narrower moving away from the centerline CL1 (W34>W35>W36). The intervals between the heating patterns 341-343 may become narrower (L32>L31) moving away from the centerline CL1.

Each of the conduction currents of the heating patterns 341-343 may be the same. That is, in order to implement the temperature profile for each turn when the same current flows, each of the widths and thicknesses of the heating patterns 341-343 and the intervals between the heating patterns 341-343 may be adjusted. However, the exemplary embodiment of FIG. 19 is not limited thereto, and each of the conduction currents of the heating patterns 341-343 may be adjusted for more precise temperature control.

The explanation so far is in regard to the exemplary embodiments corresponding to when the threshold current of the pancake coil 100 is maximized at the point where the ratio is about 2:1 (⅔) from the interior diameter to the exterior diameter on the radius (the length from R1 to R2) of the pancake coil 100. The invention is not limited thereto, and the number, widths, and thicknesses of the heating pattern and the intervals between the heating patterns according to an exemplary embodiment of the present invention may vary according to the profile of the threshold current for each turn. For example, if the induced magnetic field generated by the inner region (the inner radius) of the interior diameter R1 of the pancake coil 100 is large, the screening current may be large, and taking this into account, the number, widths, and thicknesses of the heating pattern and the intervals between the heating patterns may vary.

In addition, the present invention may include a plurality of coil layers as well as a single layer.

In FIG. 1, etc., the superconducting coil module 1 is shown to be a single layer structure implemented with the pancake coil, but the invention is not limited thereto.

Figure 20:
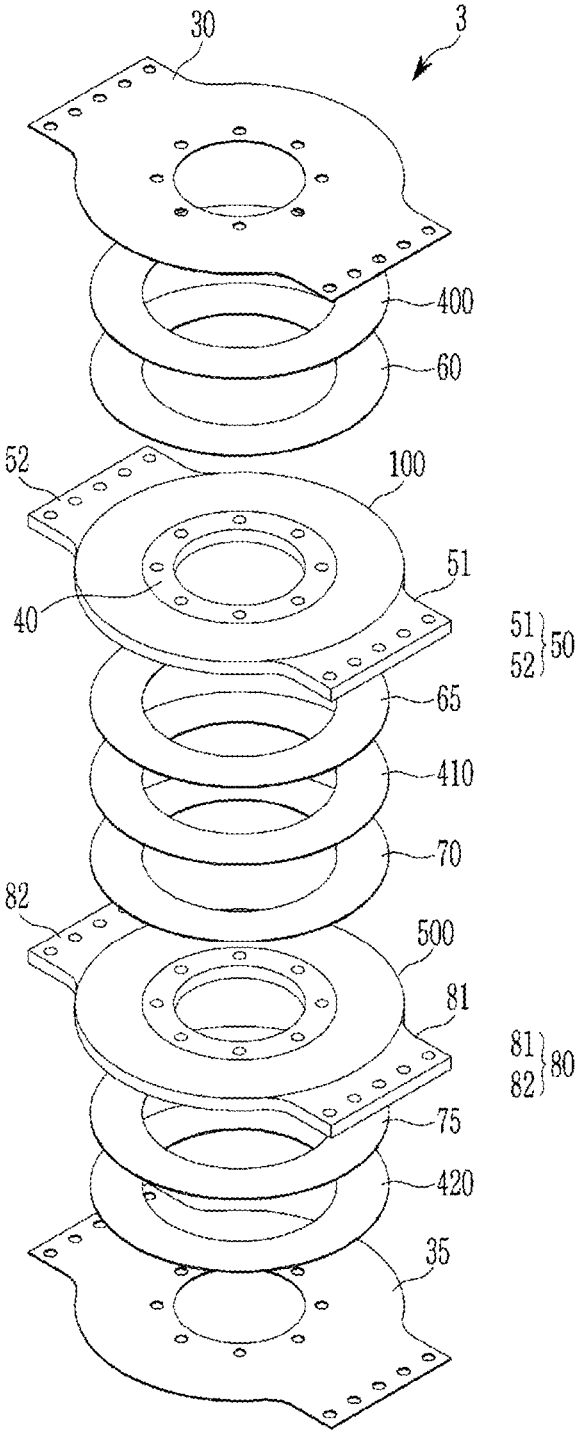
FIG. 20 is an exploded view showing a superconducting coil module of a two-layered structure according to an exemplary embodiment.

FIG. 20 is an exploded view showing a superconducting coil module of a two-layer structure according to an exemplary embodiment.

In FIG. 20, compared with the exemplary embodiment shown in FIG. 2, the same reference numerals are used for the same elements.

As shown in FIG. 20, the superconducting coil module 3 is a double structure in which two pancake coils 100 and 500 are stacked. A cooling channel 80 may be implemented in a shape suitable for the cooling space provided according to the shape of bobbin wings 30 and 35 and the thickness of the pancake coil 500 among the entire circumference of the pancake coil 500. The cooling channel 80 includes a third cooling channel 81 and a fourth cooling channel 82, but the invention is not limited thereto, and the number may vary according to the shape of the bobbin wings 30 and 35. The cooling channel 80 may be formed of copper.

The bobbin leg 40 may be mechanically attached to the inner side of the pancake coil 500. The bobbin leg 40 and the two bobbin wings 30 and 35 have holes for coupling, and a structure or groove for fastening may be formed on the inner surface of the hole.

A heating device 400 is disposed on one surface of the pancake coil 100, a heating device 410 is disposed between the one surface of the pancake coil 500 and the other surface of the pancake coil 100, and a heating device 420 is disposed on the other surface of the pancake coil 500, thereby being tightly coupled to two pancake coils 100 and 500 through the fastening of the two bobbin wings 30 and 35.

In FIG. 20, a film 70 is disposed between one surface of the pancake coil 500 and the heating device 400, and a film 75 is disposed between the other surface of the pancake coil 500 and the heating device 410.

Each of the three heating devices 400-420 includes a plurality of heating patterns, and each of the plurality of heating patterns may be implemented as an optimal pattern for controlling the temperature according to the threshold current for each turn for the pancake coil 100 and the pancake coil 500.

Like the previous exemplary embodiment, the heating pattern according to the exemplary embodiment of FIG. 20 may be designed to control the temperature according to the threshold current for each turn through the intervals between heating patterns, each of the thicknesses of the heating patterns, each of the widths of the heating patterns, and the number of the heating patterns. For example, the temperature profile for each turn or the coil radius of three heating devices 400-420 may be determined in consideration of the threshold current density for each turn or the coil radius of the pancake coil 100 and the pancake coil 500.

Figure 21:
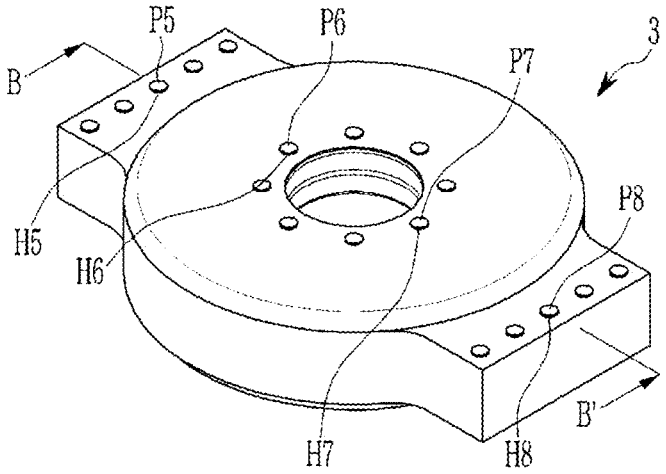
FIG. 21 is a perspective view of a superconducting coil module according to an exemplary embodiment of FIG. 20.
Figure 22:
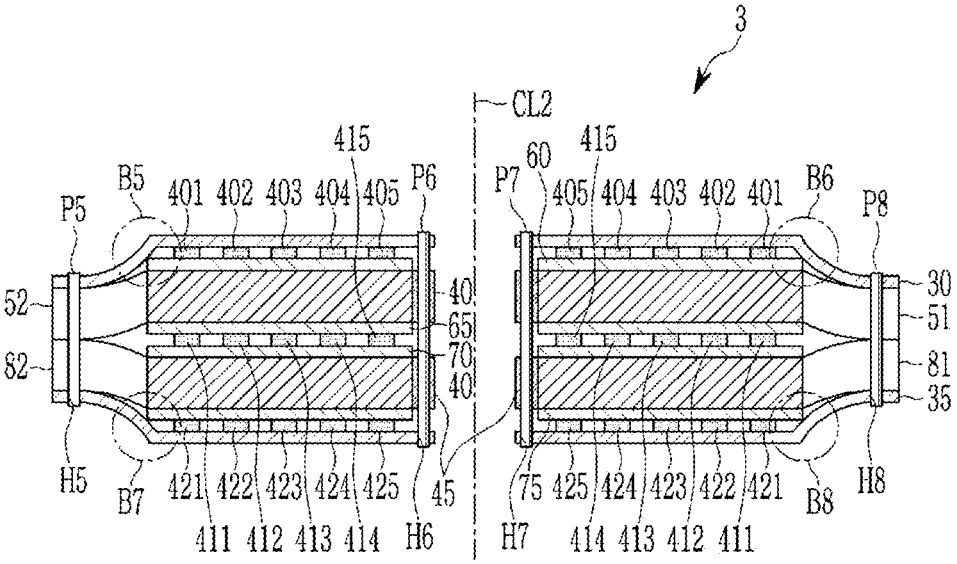
FIG. 22 is a cross-sectional view of the superconducting module shown in FIG. 21 based on a cutting line B-B'.

FIG. 21 is a perspective view of a superconducting coil module according to an exemplary embodiment of FIG. 20, and FIG. 22 is a cross-sectional view of the superconducting module shown in FIG. 21 based on a cutting line B-B'.

As shown in FIG. 21, the cutting line B-B' may pass through the hole H5-H8 of the superconducting coil module 3. The fastening means P5-P8 may be coupled to each hole. Although the shape of the fastening means in FIG. 22 is not described in detail, it is obvious that various known fastening means may be applied.

In FIG. 22, in each of three heating devices 400-420, there are five heating patterns having the same thicknesses, widths, and intervals, which is an example to illustrate the invention but is not limited thereto.

As shown in FIG. 22, as a left-right symmetric structure with respect to the centerline CL2, a film 60 is disposed between a plurality of heating patterns 401-405 and the pancake coil 100, a film 65 and a film 70 are disposed between the plurality of heating patterns 411-415 and two pancake coils 100 and 500, and a film 75 is disposed between the plurality of heating patterns 421-425 and the pancake coil 500.

A bobbin wing 30 covers the first and second cooling channels 51 and 52, the film 60, the plurality of heating patterns 401-405, and one surface of the pancake coil 100, and a bobbin wing 35 covers the third and fourth cooling channels 81 and 82, the film 75, a plurality of heating patterns 421-425, and the other surface of the pancake coil 500.

In FIG. 22, each component is shown without regard to the actual thickness of each component in order to show the stacking structure between the components according to an exemplary embodiment. In the regions B5-B8 of FIG. 21 and FIG. 22, the bobbin wings 30 and 35 are shown to have a bent shape due to the step difference of the stacking structure, and the first to fourth cooling channels 51, 52, 81, and 82 are shown to be bent, but the films 60, 65, 70, and 75 and a plurality of heating patterns 401-405, 411-415, and 421-425 substantially have the very thin thickness compared to the pancake coil and the bobbin wing, so as shown in FIG. 21 and FIG. 22, they may be substantially flat without the bending.

In addition, in FIG. 22 the plurality of heating patterns 401-405, 411-415, and 421-425 are shown, but numerous variations are possible depending on the threshold current according to each turn or the coil radius, and various exemplary embodiments thereof are described later with reference to the drawings. In the corresponding drawings, for convenience of explanation, only a portion for exposing the heating pattern in the superconducting coil module may be shown.

First, a concept of how the heating device according to an exemplary embodiment of the double superconducting coil structure controls the temperature of the heating pattern according to the threshold current according to the coil radius will be described.

Figure 23:
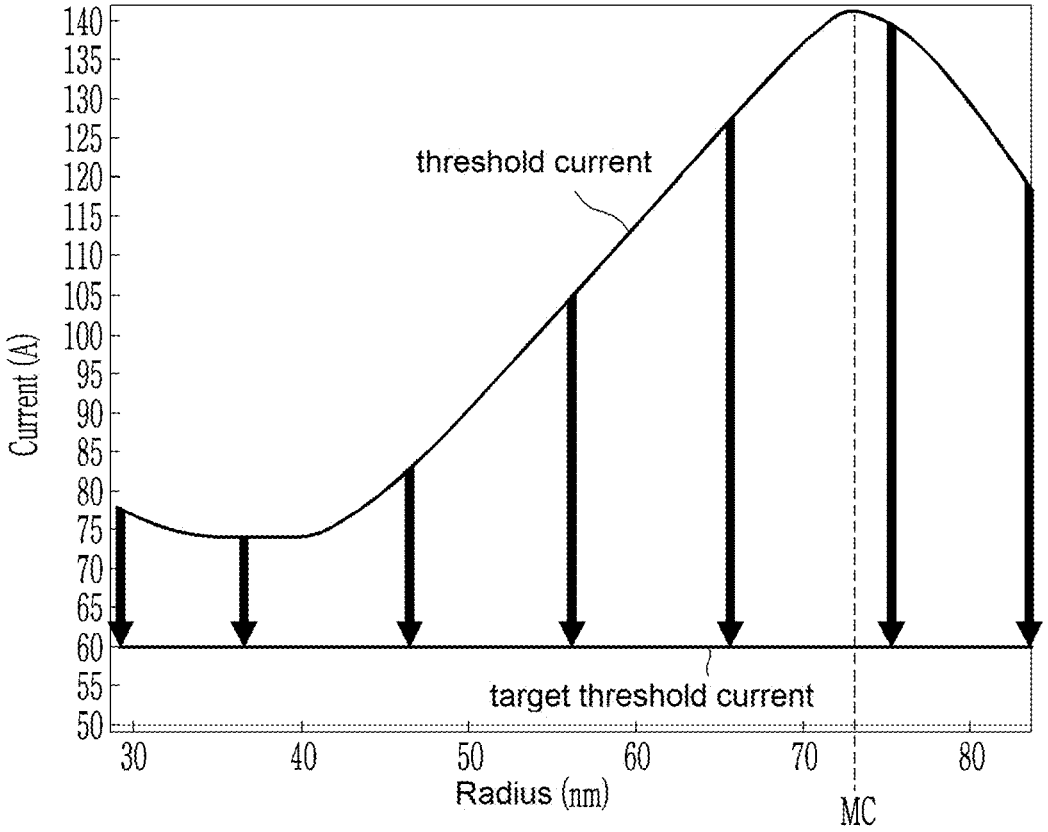
FIG. 23 is a graph showing a threshold current according to a coil radius in one coil of a double pancake coil.

FIG. 23 is a graph showing a threshold current according to a coil radius in one coil of a double pancake coil.

Among the double pancake coils, the threshold current according to the coil radius in other coils is also the same. However, each threshold current profiles of the two coils are symmetrical to each other based on the boundary between two coils.

As shown in FIG. 23, as the radius of the coil increases, the threshold current increases, and the screening current increases according to the threshold current. The heating device of an exemplary embodiment increases the temperature of the coil as the radius of the coil increases in order to attenuate the screening current.

Figure 24:
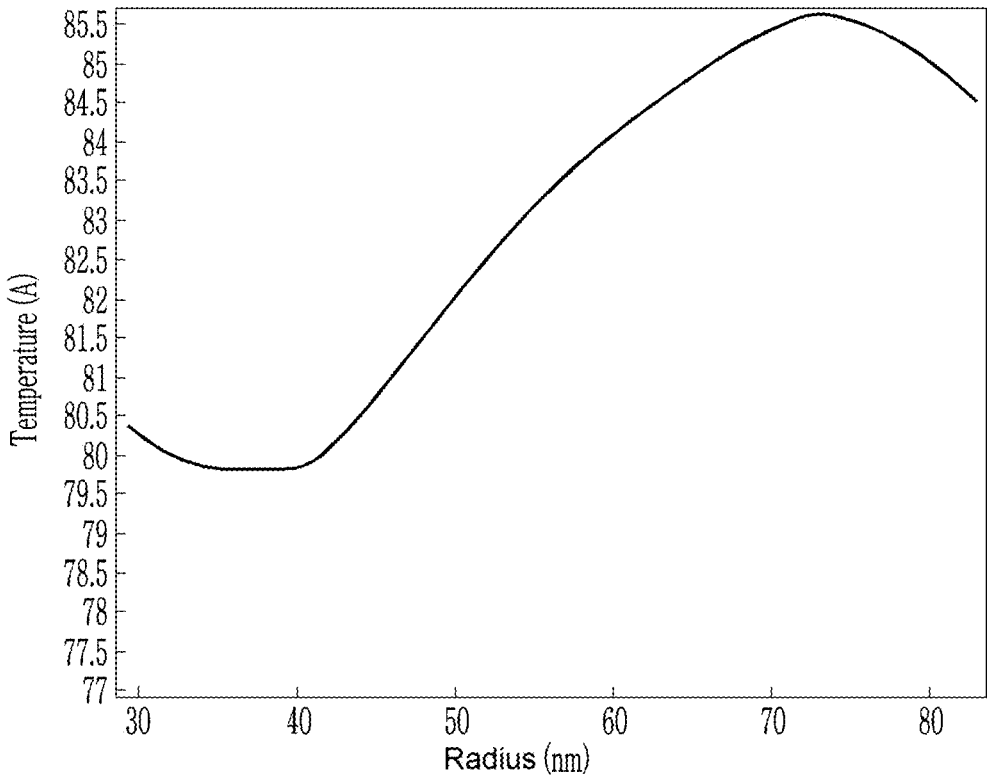
FIG. 24 is a graph showing a temperature profile according to a radius of a coil according to an exemplary embodiment corresponding to the graph of the threshold current according to the radius of the coil of FIG. 23.

FIG. 24 is a graph showing a temperature profile according to a radius of a coil according to an exemplary embodiment corresponding to the graph of the threshold current according to the radius of the coil of FIG. 23.

In the heating device according to an exemplary embodiment, the plurality of heating patterns may be realized to follow the temperature profile according to the radius of the coil shown in FIG. 24 corresponding to the threshold current profile according to the radius of the coil.

Ideally, if the heating device supplies heat to the pancake coil in accordance with the temperature profile according to the radius of the coil shown in FIG. 24, as shown in the vertical direction arrow in FIG. 23, the threshold current according to the radius of the coil decreases, so the entire pancake coil may be controlled with a target threshold current value indicated by a thick solid line. The heating device according to an exemplary embodiment may include at least one heating pattern disposed at the coil point corresponding to the highest temperature in the temperature profile according to the coil radius. Previously, in the superconducting coil of the single layer, the threshold current of the pancake coil 100 is maximized at the point where the ratio is about 2:1 (⅔ point) from the interior diameter of the pancake coil 100 to the exterior diameter. In the superconducting coil of the double-layer as well, an exemplary embodiment based on the maximum at a point (a point 'MC' in FIG. 23) where the ratio is a predetermined ratio from the interior diameter to the exterior diameter is described below. However, the present invention is not limited thereto, and the design of the heating pattern may be changed according to the threshold current profile.

Hereinafter, various heating patterns designed based on the temperature profile according to the radius of the coil shown in FIG. 24 are introduced. As described above, when the same current flows in the heating pattern, the amount of heat is different depending on the cross-sectional area of the heating pattern and the length of the heating pattern. For example, as the cross-sectional area increases (decreases), the amount of heat decreases (increases), and as the length of the heating pattern becomes longer (shorter), the amount of heat increases (decreases). As the position of the heating pattern moves away from the centerline of the coil, the length of the heating pattern increases, and the resistance increases under the same current condition, resulting in an increase in the amount of heat generated. When the interval between a plurality of heating patterns is the same, at least one of each of the conduction currents of a plurality of heating patterns, and the number of patterns, may be design parameters for controlling the amount of heat generated.

Figure 25:
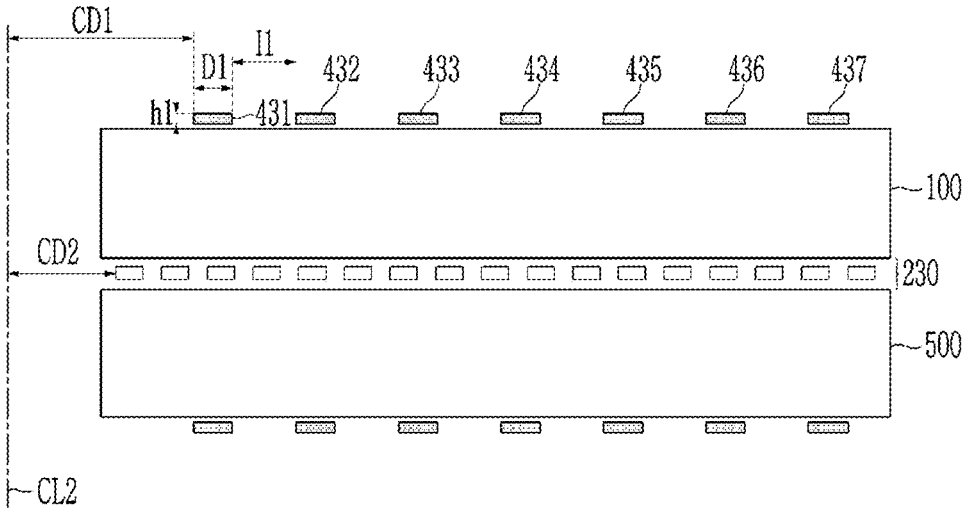
FIG. 25 to FIG. 37 are views of a cross-section of a heating pattern according to an exemplary embodiment.

FIG. 25 is a view showing a cross-section of a heating pattern according to an exemplary embodiment.

As shown in FIG. 25, the heating device 400 and the heating device 420 are symmetrical with respect to a predetermined reference line, for example, a horizontal line at which the heating device 410 is disposed, and each of the plurality of heating patterns is the same. Hereinafter, since it is the same in the exemplary embodiment, only a plurality of heating patterns of the heating device 400 is described with the reference numerals.

In addition, a plurality of heating patterns of the heating device 410 have a constant thickness and width, the interval between the heating patterns is constant, and the number of a plurality of heating patterns is also the same in the following exemplary embodiments. Therefore, the description of a plurality of heating patterns of the heating device 410 is omitted. In this case, the length of a plurality of heating patterns of the heating device 410 is longer as the distance from the centerline CL2 increases, and the resistance value thereof is larger and the amount of heat generated may increase as the distance from the centerline CL2 increases. In this way, after fixing the heating pattern of the heating device 410 disposed in the middle of three heating devices 400-420, the plurality of heating patterns of the heating device 400 and the heating device 420 may be implemented to follow the temperature profile according to the coil radius shown in FIG. 24. Hereinafter, in an exemplary embodiment, it is assumed that the heating patterns of the heating device 410 have the same thickness and width, and intervals between the heating patterns are constant. However, the heating pattern of the heating device 410 is not limited thereto, and at least one of the number, thickness, and width of the heating pattern, and the interval between the heating patterns, may be changed according to a design. Even in this case, after the heating pattern of the heating device 410 is first designed, the heating patterns of the heating devices 400 and 420 may be designed based thereon.

In addition, in FIG. 25, the distances CD1 and CD2 from the centerline CL2 to the heating pattern (e.g., 431) of the nearest heating device 400, 410, or 420 may also be changed according to the design to implement the temperature profile according to the coil radius. This applies equally to all exemplary embodiments below.

FIG. 25 is a view showing a cross-section of a heating pattern according to an exemplary embodiment.

For convenience of explanation, in FIG. 25, only the right region of the pancake coils 100 and 500 and the right heating pattern of the heating device 400-420 are shown based on the centerline CL2 (referring to FIG. 22). In addition, by assuming that the temperature profiles according to each turn or the coil radius for the pancake coil 100 and the pancake coil 500 are the same, the heating patterns (corresponding to the heating patterns 421-425 in FIG. 22) positioned on the other surface of the pancake coil 500 are assumed to be the same as the heating pattern (the heating patterns 401-405 in FIG. 22) positioned on one surface of the pancake coil 100. Accordingly, in FIG. 25, the heating pattern positioned on the other surface of the pancake coil 500 is the same as a plurality of heating patterns 431-437, and this is equally applied to following exemplary embodiments.

As shown in FIG. 25, a plurality of heating patterns 431-437 have the same thickness h1 and width D1, the interval I1 between the plurality of heating patterns 431-437 is the same, and the number thereof is seven. In order to implement the temperature profile (e.g., FIG. 24) according to the coil radius according to the threshold current according to the coil radius, each of the conduction currents of the plurality of heating patterns 431-437 may be controlled. For example, in FIG. 25, as the distance from the centerline CL2 increases, the length of the heating patterns 431-437 becomes longer, so in the condition where the same current flows, the heating value may increase as the distance from centerline CL2 increases. In the temperature profile for each turn shown in FIG. 24, since the temperature decreases up to the coil radius of 40 mm and then increases after the coil radius of 40 mm, the conduction current of the heating pattern 432 may be less than the conduction current of the heating pattern 431 to implement this.

In FIG. 25, seven heating patterns are shown, but it may also be designed with an appropriate number to implement the temperature profile for each turn (e.g., as in FIG. 24).

Figure 26:
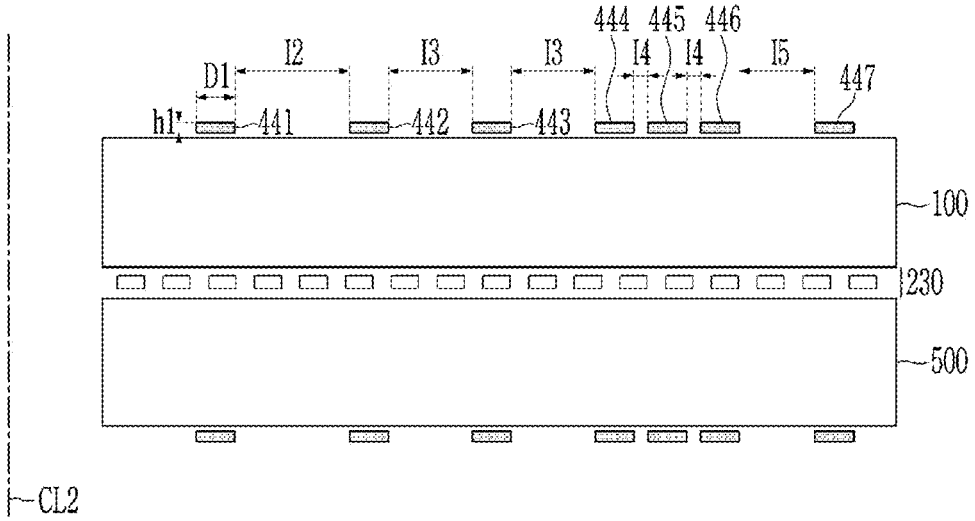

FIG. 26 is a view showing a cross-section of a heating pattern according to an exemplary embodiment.

In the exemplary embodiment of FIG. 26, the intervals between I2-I7 of heating patterns 441-447 are different. For example, as the distance from the centerline CL2 increases, the intervals becomes shorter (I2>I3>I4), and then the interval I5 becomes longer. In FIG. 26, the interval I4 between the heating patterns 444-446 is shown to be same, however the exemplary embodiment is not limited thereto and it may be different, such as gradually decreasing, or decreasing and then increasing.

Each of the conduction currents of the heating patterns 441-447 may be the same. That is, the interval between the heating patterns 441-447 may be adjusted to implement the temperature profile according to the coil radius when the same current flows. However, the exemplary embodiment of FIG. 26 is not limited thereto, and the conduction current of the heating patterns 441-447 may be adjusted for more precise temperature control.

Figure 27:
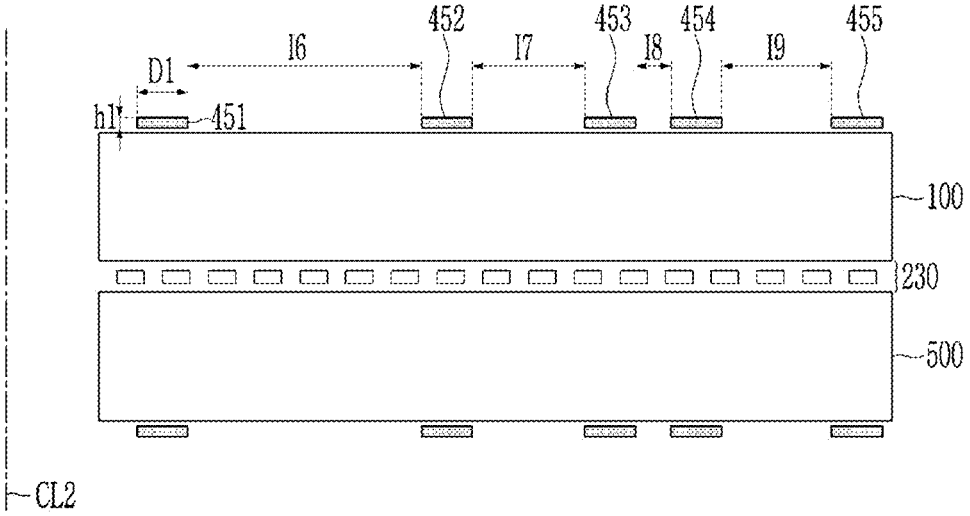

FIG. 27 is a view showing a cross-section of a heating pattern according to an exemplary embodiment.

In the exemplary embodiment of FIG. 27, the number of heating patterns 451-455 is different from that of the exemplary embodiment of FIG. 25, and the intervals I6-I9 between the heating patterns 451-455 are different. For example, as the distance from the centerline CL2 becomes shorter, the intervals becomes shorter (I6>I7>I8) and then the interval I9 becomes longer.

Each of the conduction currents of the heating patterns 451-455 may be the same. That is, the number of heating patterns 451-455 and the interval between the heating patterns 451-455 may be adjusted to implement the temperature profile according to the coil radius when the same current flows. However, the exemplary embodiment of FIG. 27 is not limited thereto, and the number of heating patterns 451-455 may be different from that shown in FIG. 27 and each of the conduction currents of the heating patterns 451-455 may be adjusted for more precise temperature control.

Figure 28:
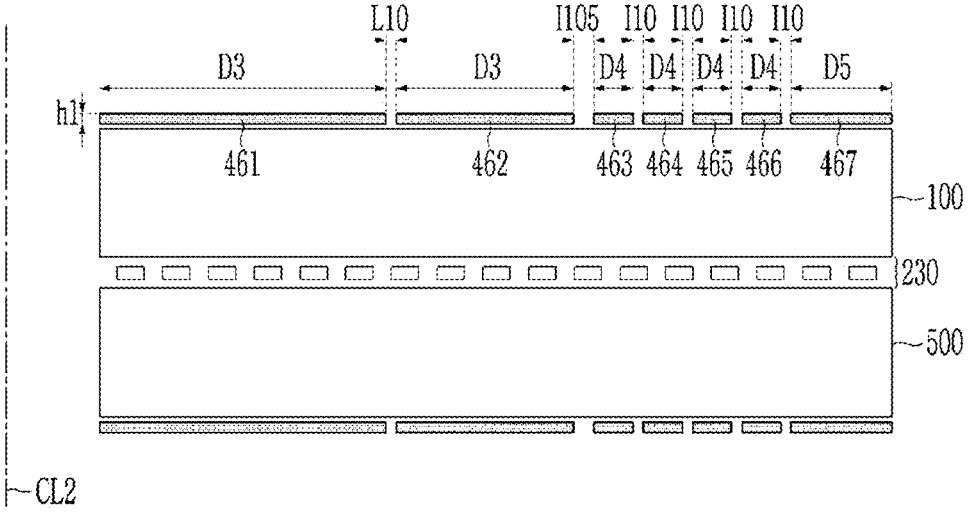

FIG. 28 is a view showing a cross-section of a heating pattern according to an exemplary embodiment.

In the exemplary embodiment of FIG. 28, the widths D2-D5 of heating patterns 461-467 are different. For example, as the distance from the centerline CL2 becomes shorter, the widths becomes shorter (D2>D3>D4) and then the width D5 becomes longer. In FIG. 10, it is shown that the widths D4 of the heating patterns 253-256 are the same, however the exemplary embodiment of FIG. 10 is not limited thereto and the widths of the heating patterns 253-256 may be different such as gradually decreasing, or decreasing and then increasing. In the exemplary embodiment shown in FIG. 28, the intervals I10 between the heating patterns 461-462 and 463-467 are the same, and the interval I105 between the heating patterns 462 and 463 is wider than the interval I10.

Each of the conduction currents of the heating patterns 461-467 may be the same. That is, each of the widths of the heating patterns 461-467 may be adjusted to implement the temperature profile according to the coil radius when the same current flows. However, the exemplary embodiment of FIG. 28 is not limited thereto, and each of the conduction currents of the heating patterns 461-467 may be adjusted for more precise temperature control.

Figure 29:
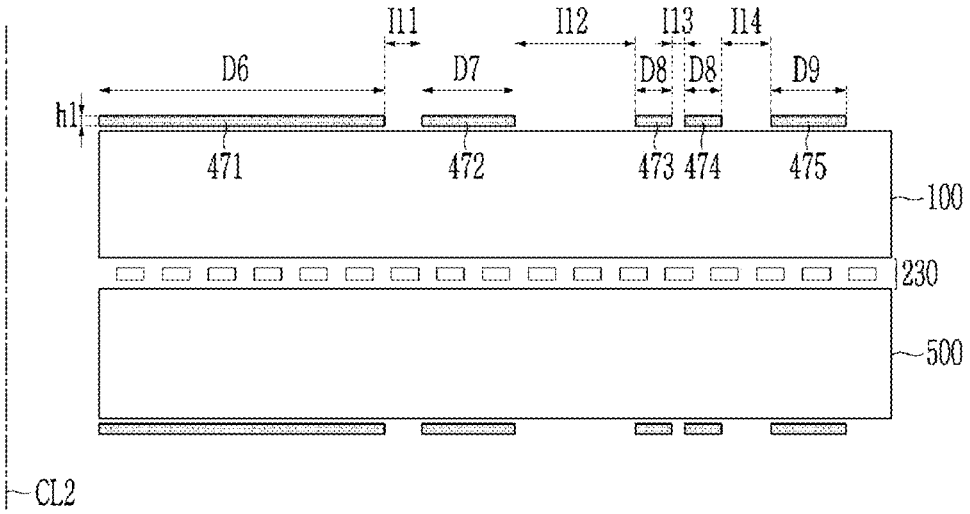

FIG. 29 is a view showing a cross-section of a heating pattern according to an exemplary embodiment.

In the exemplary embodiment of FIG. 29, the number of heating patterns 471-475 is different from that of the exemplary embodiment of FIG. 25, and the widths D6-D9 and intervals I11-I14 of the heating patterns 471-475 are different. In the exemplary embodiment shown in FIG. 29, the number of the heating patterns 471-475 is five, the interval between the heating patterns 471-475 is longer (I11>I12), shorter (I12>I13), and then again longer (I14>I13) as the distance from the centerline CL2 increases. Also, as the distance from the centerline CL2 increases, the widths of the heating patterns 471-475 may become shorter (D6>D7>D8) and then the width D9 may become longer (D9>D8). In FIG. 29, it is shown that the widths D4 of the heating patterns 473-474 are the same, however the exemplary embodiment of FIG. 29 is not limited thereto and may be different.

Each of the conduction currents of the heating patterns 471-475 may be the same. That is, in order to implement the temperature profile according to the coil radius when the same current flows, the number of the heating patterns 471-475 and the intervals between the heating patterns 471-475 and each of the widths may be adjusted. However, the exemplary embodiment of FIG. 29 is not limited thereto, and each of the conduction currents of the heating patterns 471-475 may be adjusted for more precise temperature control.

Figure 30:
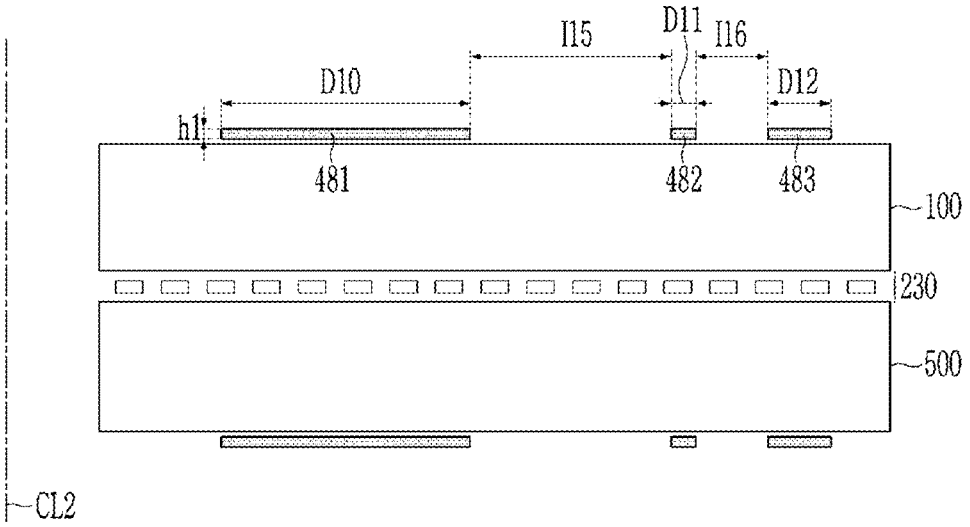

FIG. 30 is a view showing a cross-section of a heating pattern according to an exemplary embodiment.

In the exemplary embodiment of FIG. 30, the number of heating patterns 481-483 is different from that of the exemplary embodiment of FIG. 25, and the widths D10-D12 and the intervals I15-I16 of the heating patterns 481-483 are different from each other. In the exemplary embodiment shown in FIG. 30, the number of the heating patterns 481-483 is three, and the intervals between the heating patterns 481-483 may be shorter further away from the centerline CL2 (I15>I16). Also, as the distance from the centerline CL2 increases, the widths of the heating patterns 481-483 may become shorter (D10>D11), and then the widths may become longer (D12>D11).

Each of the conduction currents of the heating patterns 481-483 may be the same. That is, in order to implement the temperature profile according to the coil radius when the same current flows, the number of heating patterns 481-483 and the intervals between the heating patterns 481-483 and each of the widths thereof may be adjusted. However, the exemplary embodiment FIG. 30 is not limited thereto, and each of the conduction currents of the heating patterns 481-483 may be adjusted for more precise temperature control.

Figure 31:
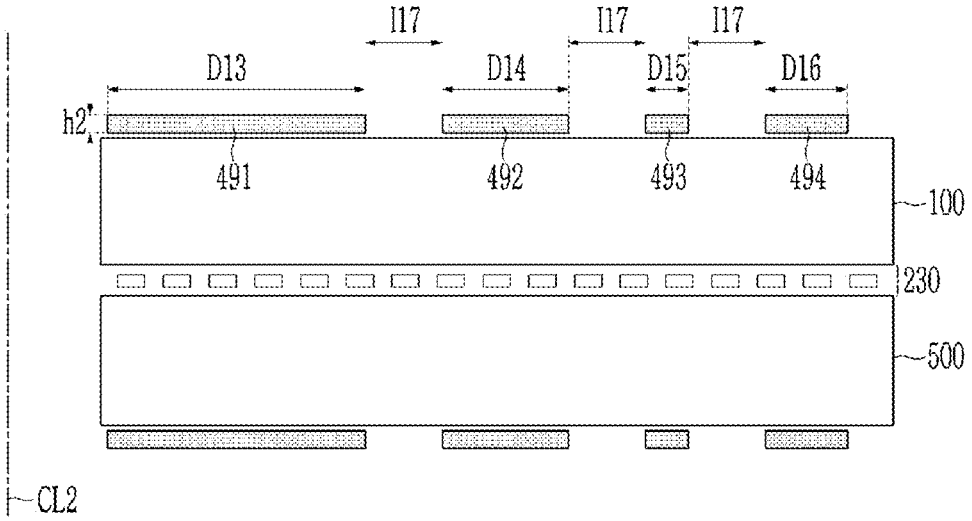

FIG. 31 is a view showing a cross-section of a heating pattern according to an exemplary embodiment.

In the exemplary embodiment of FIG. 31 compared with the exemplary embodiment shown in FIG. 25, the thickness of the heating patterns 491-494 is different and the width D2-D5 of the heating patterns 491-494 is different. In the exemplary embodiment shown in FIG. 31, the intervals I17 between the heating patterns 491-494 is constant. For example, the thickness h2 of the heating patterns 491-494 is thicker than the thickness h1. As the distance from the centerline CL2 increases, the widths of the heating patterns 491-494 may become shorter (D13>D14>D15) and longer (D16>D15).

Each of the conduction currents of the heating patterns 491-494 may be the same. That is, each of the widths of the heating patterns 491-494 may be adjusted to implement the temperature profile according to the coil radius when the same current flows. However, the exemplary embodiment of FIG. 31 is not limited to this, and each of the conduction currents of the heating patterns 491-494 may be adjusted for more precise temperature control.

Figure 32:
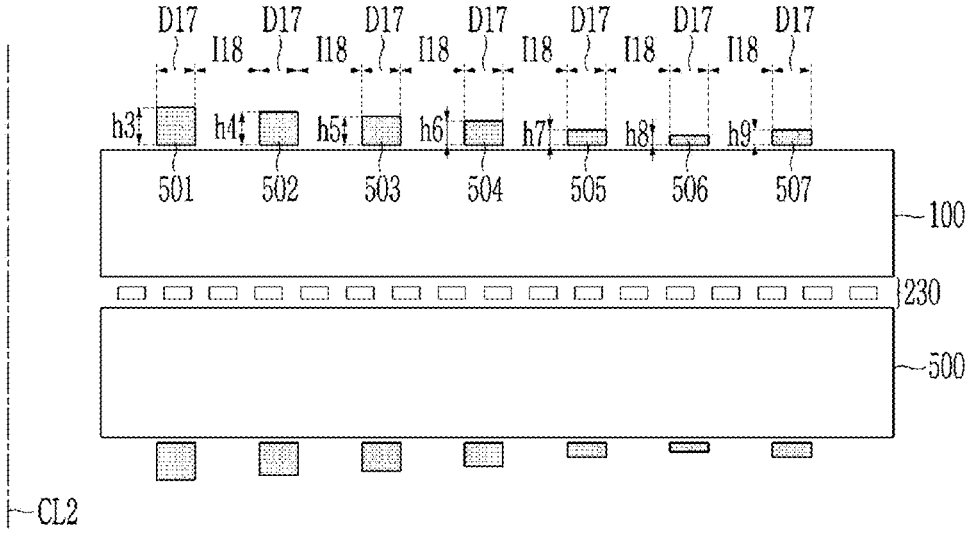

FIG. 32 is a view showing a cross-section of a heating pattern according to an exemplary embodiment.

In the exemplary embodiment of FIG. 32, the thicknesses of the heating patterns 501-507 are different, and the widths D17 of the heating patterns 501-507 and the intervals between the heating patterns 501-507 are constant. In the exemplary embodiment shown in FIG. 32, the thicknesses of the heating patterns 501-507 may become thinner away from the centerline CL2 (h3>h4>h5>h6>h7>h8) and then become thicker (h9>h8).

Each of the conduction currents of the heating patterns 501-507 may be the same. That is, when the same current flows, each of the thicknesses of the heating patterns 501-507 may be adjusted to implement the temperature profile according to the coil radius. However, the exemplary embodiment of FIG. 32 is not limited thereto, and each of the conduction currents of the heating patterns 501-507 may be adjusted for more precise temperature control.

Figure 33:
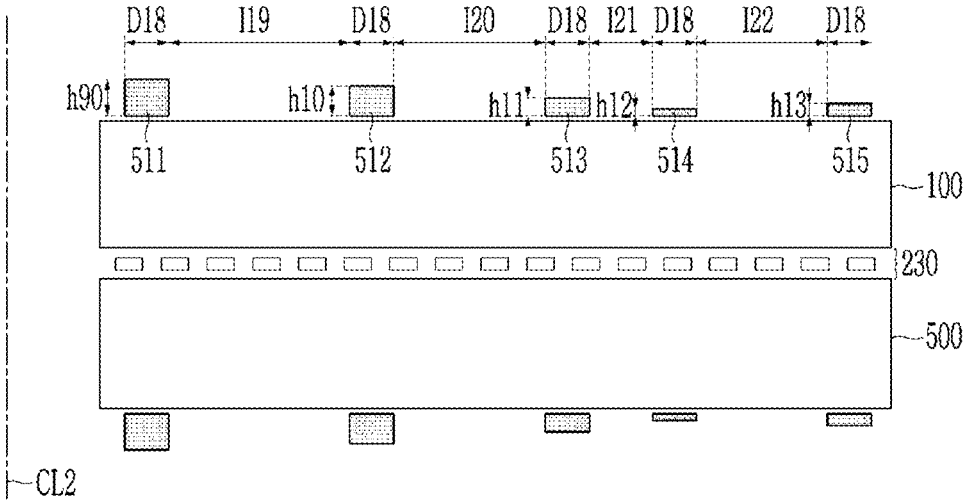

FIG. 33 is a view showing a cross-section of a heating pattern according to an exemplary embodiment.

In the exemplary embodiment of FIG. 33, the thicknesses of the heating patterns 511-515 and the intervals between the heating patterns 511-515 are different from each other and the widths D18 of the heating patterns 511-515 are constant. In the exemplary embodiment show in FIG. 33, the number of the heating patterns 511-515 is five and thicknesses of the heating patterns 511-515 may become thinner (h90>h10>h11>h12) and then thicker (h13>h12) as the distance from the centerline CL2 increases. The intervals between the heating patterns 511-515 may be shorter (I19>I20>I21) and then longer (I22>I21) away from the centerline CL2.

Each of the conduction currents of the heating patterns 511-515 may be the same. That is, each of the thicknesses of the heating patterns 511-515 and the intervals between the heating patterns 511-515 may be adjusted to implement the temperature profile according to the coil radius when the same current flows. However, the exemplary embodiment of FIG. 33 is not limited to thereto, and each of the conduction currents of the heating patterns 511-515 may be adjusted for more precise temperature control.

Figure 34:
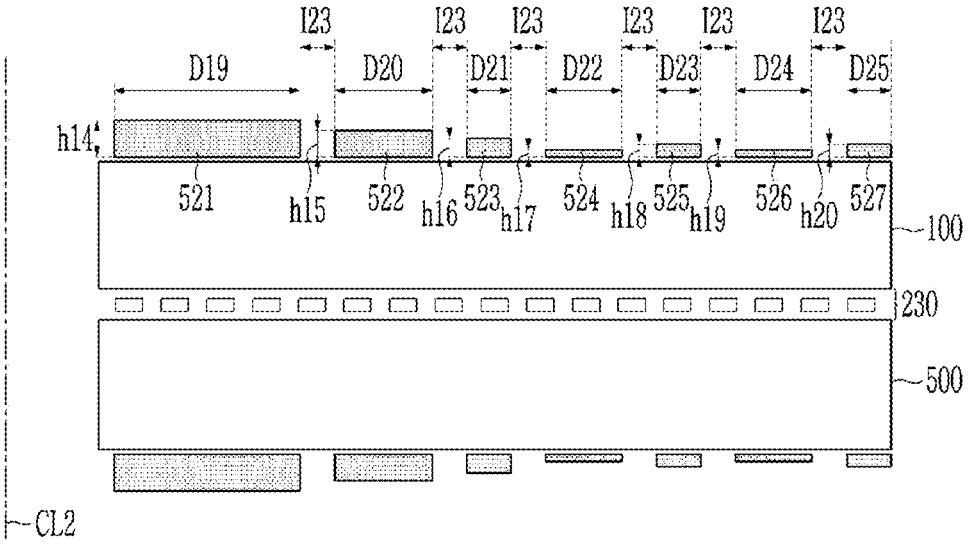

FIG. 34 is a view showing a cross-section of a heating pattern according to an exemplary embodiment.

In the exemplary embodiment of FIG. 34, the widths D19-D25 and the thicknesses h14-h20 of heating patterns 521-527 are different from each other and the intervals I23 between the heating patterns 521-527 may be constant. In the exemplary embodiment shown in FIG. 34, the number of the heating patterns 521-527 is seven, and the thicknesses of the heating pattern 521-527 may be thinner (h14>h15>h16>h17) away from the centerline CL2, thicker (h18>h17), and then thinner again (h20>h19). The widths of the heating patterns 521-527 may be narrowed (D19>D20>D21) away from the centerline CL2, widened (D22>D21), and then narrowed again (D22>D23). Subsequently, the width of the heating patterns 521-527 may be widened again D24>D23 and narrowed again (D24>D25).

Figure 35:
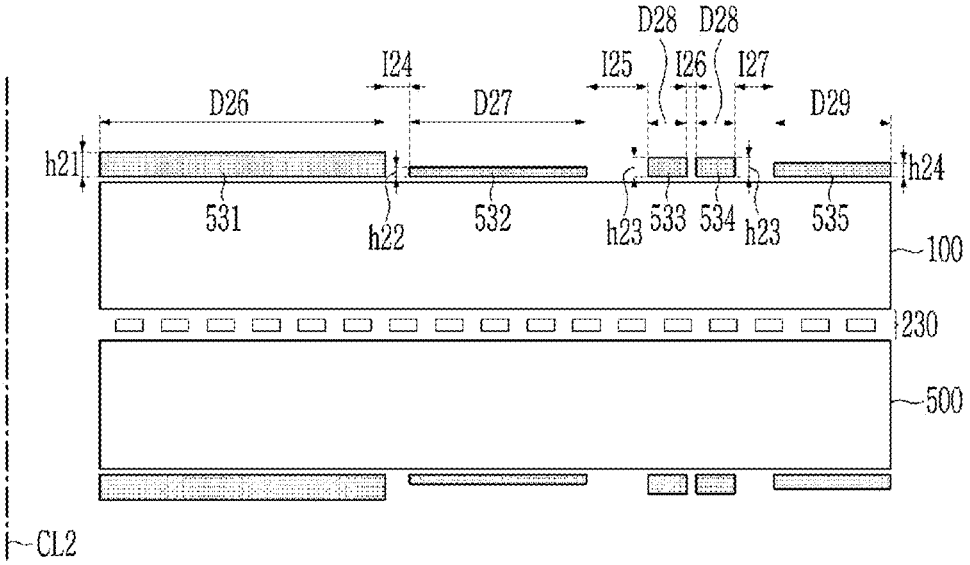

Each of the conduction currents of the heating patterns 521-527 may be the same. That is, each of the widths and thicknesses of the heating patterns 521-527 may be adjusted to implement the temperature profile according to the coil radius when the same current flows. However, the exemplary embodiment of FIG. 34 is not limited thereto, and each of the conduction currents of the heating patterns 521-527 may be adjusted for more precise temperature control. FIG. 35 is a view showing a cross-section of a heating pattern according to an exemplary embodiment.

In the exemplary embodiment of FIG. 35, the widths D26-D29 and thicknesses h21-h24 of the heating patterns 531-535 may be different from each other and the intervals I24-I27 between the heating patterns 531-535 may also be different from each other. In the exemplary embodiment shown in FIG. 35, the number of heating patterns 531-535 is five, and the thicknesses of the heating patterns 531-535 become thinner (h21>h22>h23) and thicker (h24>h23) as the distance from the centerline CL2 increases. The widths of the heating patterns 531-535 may be narrower (D26>D27>D28) and wider (D29>D28) moving away from the centerline CL2. The intervals between the heating patterns 531-535 may widen (I25>I24) moving away from the centerline CL2, narrow (I25>I26), and again widen (I27>I26).

Each of the conduction currents of the heating patterns 531-535 may be the same. That is, when the same current flows, each of the widths and thicknesses of the heating patterns 531-535, and the intervals between the heating patterns 531-535 may be adjusted to implement the temperature profile according to the coil radius. However, the exemplary embodiment of FIG. 35 is not limited thereto, and each of the conduction currents of the heating patterns 531-535 may be adjusted for more precise temperature control.

Figure 36:
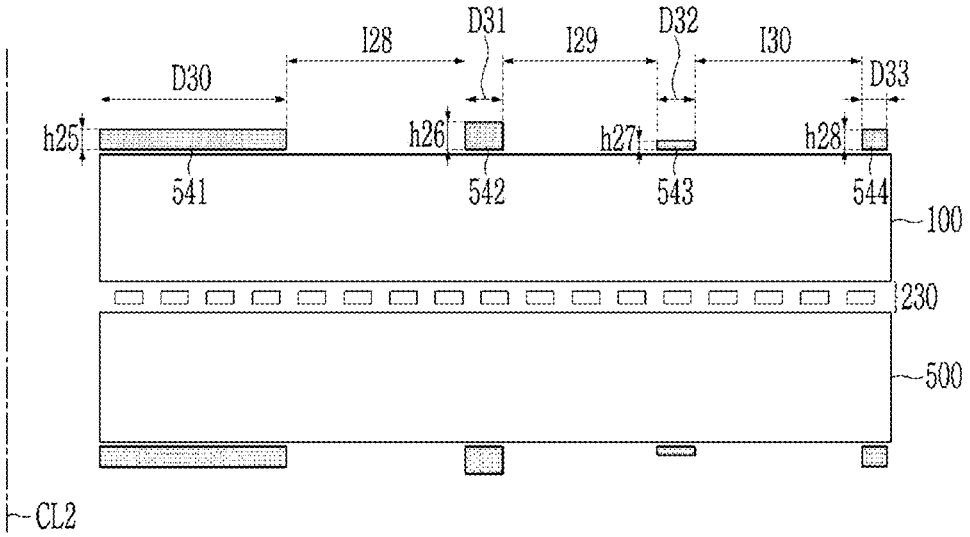

FIG. 36 is a view showing a cross-section of a heating pattern according to an exemplary embodiment.

In the exemplary embodiment of FIG. 36, widths D30-D33 and thicknesses h25-h28 of the heating patterns 541-544 may be different, and the intervals I28-I30 between the heating patterns 541-544 may be different. In the exemplary embodiment shown in FIG. 36, the number of heating patterns 541-544 is four, and the thicknesses of the heating patterns 541-544 become thicker (h26>h25), thinner (h26>h27), and thicker again (h28>h27) moving away from the centerline CL2. The widths of the heating patterns 541-544 may be narrower (D30>D31), wider (D32>D21), and narrower again (D32>D33) moving away from the centerline CL2. The widths of the heating patterns 541-544 may be narrower (D30>D31), wider (D32>D21), and narrower again (D32>D33) moving away from the centerline CL2.

Each of the conduction currents of the heating patterns 541-544 may be the same. That is, each of the widths and thicknesses of the heating patterns 541-544 and the intervals between the heating patterns 541-544 may be adjusted to implement the temperature profile according to the coil radius when the same current flows. However, the exemplary embodiment FIG. 36 is not limited thereto, and each of the conduction currents of the heating pattern 541-544 may be adjusted for more precise temperature control.

Figure 37:
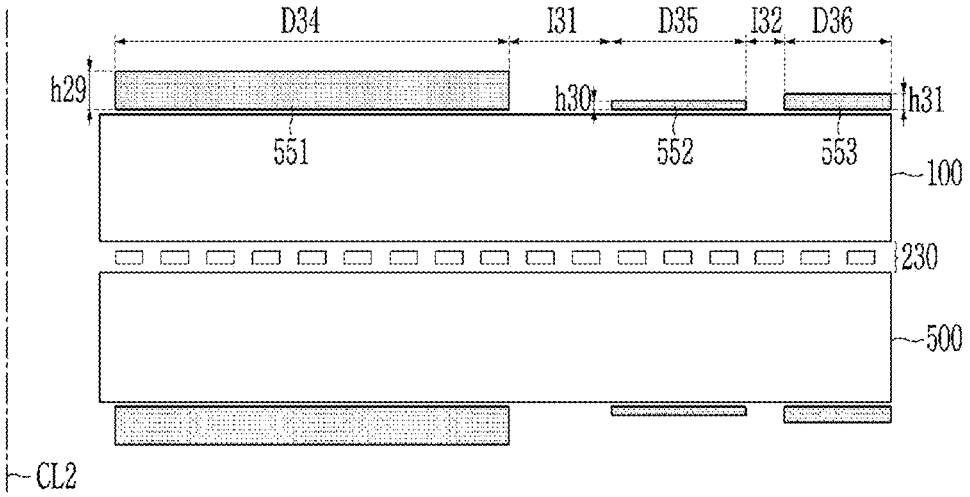

FIG. 37 is a view showing a cross-section of a heating pattern according to an exemplary embodiment.

In the exemplary embodiment of FIG. 37, the widths D34-D36 and thicknesses h29-h31 of heating patterns 551-553 may be different, and the interval I31-I32 between the heating pattern 551-553 may be different. In the exemplary embodiment shown in FIG. 37, the number of heating patterns 551-553 is three, and the thicknesses of the heating pattern 551-553 become thinner h30>h29 and thicker h31>h30 moving away from the centerline CL2. The widths of the heating patterns 551-553 may be narrower (D34>D35>D36) away from the centerline CL2. The intervals between the heating patterns 551-553 may be narrower (I32>I31) moving away from the centerline CL2.

Each of the conduction currents of the heating patterns 551-553 may be the same. That is, each of the widths and thicknesses of the heating patterns 551-553 and the intervals between the heating patterns 551-553 may be adjusted to implement the temperature profile according to the coil radius when the same current flows. However, the exemplary embodiment of FIG. 37 is not limited thereto, and each of the conduction currents of the heating patterns 551-553 may be adjusted for more precise temperature control.

The heating devices 400, 410, and 420 to provide the temperature profile according to the coil radius depending on each threshold current profile of the pancake coils 100 and 500 of the two-layer structure were described with reference to FIG. 20 to FIG. 37. The present invention is not limited to the two-layer structure, and the present invention may be applied to a pancake coil of three or more layers. That is, the number, width, and thickness of each heating pattern of the heating device and the intervals between of the heating patterns may vary according to the profile of the threshold current according to each turn or the coil radius.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

DESCRIPTION OF SYMBOLS

1: superconducting coil module
10, 100, 500: pancake coil
20, 200, 210, 220, 230: heating device
30, 35: bobbin wing
40: bobbin leg
50: cooling channel

What is claimed is:

1. A superconducting coil module comprising:
a first coil composed of a superconducting wire material wound multiple times; and
a first heating device coupled to one surface of the first coil and including at least one first heating pattern controlling a threshold current for each turn of the first coil to a minimum threshold current,
wherein at least one first heating pattern is disposed on a path according to a predetermined ratio between the inner and outer boundaries of the first coil.

2. The superconducting coil module of claim 1, wherein the predetermined ratio may depend on where the threshold current for each turn is a highest point in the first coil.

3. The superconducting coil module of claim 1, wherein the first heating device includes a plurality of first heating patterns, the plurality of first heating patterns include at least one first heating pattern, and
the plurality of first heating patterns are disposed at a constant interval along a direction from the outside to the inside of the first coil on a cross-section of the superconducting coil module.

4. The superconducting coil module of claim 3, wherein a width of at least one of the plurality of first heating patterns is different from a width of another first heating pattern.

5. The superconducting coil module of claim 3, wherein a thickness of at least one among the plurality of first heating patterns is different from a thickness of other first heating patterns.

6. The superconducting coil module of claim 1, wherein the first heating device includes a plurality of first heating patterns including at least one first heating pattern,
on a cross-section of the superconducting coil module, at least one interval among the intervals between the plurality of first heating patterns is different from other intervals.

7. The superconducting coil module of claim 6, wherein a width of at least one among the plurality of first heating patterns is different from a width of other first heating patterns.

8. The superconducting coil module of claim 6, wherein a thickness of at least one among the plurality of first heating patterns is different from a thickness of other first heating patterns.

9. The superconducting coil module of claim 1, wherein the first heating device includes a plurality of first heating patterns including at least one first heating pattern,
at least one of the intervals between the plurality of first heating patterns, each of the widths of the plurality of first heating patterns, each of the thicknesses of the plurality of first heating patterns, and the number of the plurality of first heating patterns is determined depending on a temperature profile for each turn according to a threshold current profile for each turn of the first coil.

10. The superconducting coil module of claim 1, further comprising
a second heating device coupled to the other surface of the first coil and including at least one second heating pattern controlling the threshold current for each turn of the first coil as a minimum threshold current, and
the at least one second heating pattern is disposed on a path according to the predetermined ratio between the inside and outside boundaries of the first coil.

11. The superconducting coil module of claim 10, wherein the predetermined ratio may depend on where the threshold current for each turn is a highest point in the first coil.

* * * * *